US010176781B2

(12) United States Patent
Greenebaum et al.

(10) Patent No.: US 10,176,781 B2
(45) Date of Patent: Jan. 8, 2019

(54) AMBIENT DISPLAY ADAPTATION FOR PRIVACY SCREENS

(71) Applicant: Apple Inc., Cupertino, CA (US)

(72) Inventors: Kenneth I. Greenebaum, San Carlos, CA (US); Robert L. Ridenour, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 86 days.

(21) Appl. No.: 15/273,285

(22) Filed: Sep. 22, 2016

(65) Prior Publication Data

US 2017/0092229 A1 Mar. 30, 2017

Related U.S. Application Data

(60) Provisional application No. 62/235,022, filed on Sep. 30, 2015.

(51) Int. Cl.

| | |
|---|---|
| ***G09G 5/10*** | (2006.01) |
| ***G09G 5/02*** | (2006.01) |
| *G09G 5/06* | (2006.01) |

(52) U.S. Cl.

CPC ..... *G09G 5/10* (2013.01); *G09G 5/02* (2013.01); *G09G 5/06* (2013.01); *G09G 2320/068* (2013.01); *G09G 2320/0666* (2013.01); *G09G 2320/0673* (2013.01); *G09G 2354/00* (2013.01); *G09G 2358/00* (2013.01); *G09G 2360/144* (2013.01)

(58) Field of Classification Search

CPC ..... G09G 5/02; G09G 2320/0666; G09G 2320/0673; H04N 2201/326; H04N 1/60

See application file for complete search history.

(56) References Cited

U.S. PATENT DOCUMENTS

| | | | |
|---|---|---|---|
| 6,160,655 | A | 12/2000 | Fix |
| 2002/0180751 | A1 | 12/2002 | Rozzi |
| 2004/0008208 | A1 | 1/2004 | Dresevic |

(Continued)

OTHER PUBLICATIONS

Marcu, Gabriel, "Gamut Mapping in Munsell Constant Hue Sections", The Sixth Color Imaging Conference: Color Science, Systems, and Applications, pp. 159-162 (1998).

(Continued)

*Primary Examiner* — Antonio A Caschera
(74) *Attorney, Agent, or Firm* — Blank Rome LLP

(57) ABSTRACT

A display device is used in conjunction with: (1) optical sensors to collect information about ambient conditions in the environment of a viewer of the display device; and/or (2) privacy element identification and detection mechanisms (PEDMs) to collect information about the presence, orientation, and/or type of privacy elements being used in conjunction with the display device. For one embodiment, a processor in communication with the display device may create a view model based, at least in part, on the predicted effects of the ambient environmental conditions and/or presence of privacy elements being used in conjunction with the display device on the user's viewing experience. The view model may be a function of gamma, black point, white point, privacy element orientation and/or type, backlighting, field of view, number of viewers, color offset, or a combination thereof. The view model is also referred to as an ambient/privacy model.

24 Claims, 12 Drawing Sheets

(56) References Cited

U.S. PATENT DOCUMENTS

| | | | | |
|---|---|---|---|---|
| 2005/0117186 | A1 | 6/2005 | Li | |
| 2006/0284895 | A1 | 12/2006 | Marcu | |
| 2008/0080047 | A1 | 4/2008 | Field | |
| 2008/0165292 | A1 | 7/2008 | Bing | |
| 2008/0303918 | A1 | 12/2008 | Keithley | |
| 2010/0079426 | A1 | 4/2010 | Pance | |
| 2010/0124363 | A1 | 5/2010 | Ek | |
| 2010/0275266 | A1 | 10/2010 | Jakobson | |
| 2011/0141366 | A1 | 6/2011 | Yoon | |
| 2011/0298817 | A1 | 12/2011 | Oshinome | |
| 2014/0082745 | A1 | 3/2014 | Guedalia | |
| 2016/0110846 | A1* | 4/2016 | Park | G06T 5/00 345/589 |

OTHER PUBLICATIONS

Moroney, Nathan, et al., "The CIECAMO2 Color Appearance Model", IS&T/SID Tenth Color Imaging Conference, pp. 23-27 (2002).

* cited by examiner

AMBIENT DISPLAY ADAPTATION FOR PRIVACY SCREENS

CROSS-REFERENCE TO RELATED APPLICATION

This Application is related to U.S. Pat. No. 8,704,859, entitled, "DYNAMIC DISPLAY ADJUSTMENT BASED ON AMBIENT CONDITIONS," which claims priority to a provisional application 61/388,464 filed on Sep. 30, 2010, and which is hereby incorporated by reference in its entirety.

This Application claims priority to U.S. Provisional Patent Application No. 62/235,022, entitled "AMBIENT DISPLAY ADAPTATION FOR PRIVACY SCREENS," which was filed on Sep. 30, 2015 and which is hereby incorporated by reference in its entirety.

BACKGROUND

This disclosure relates generally to the field of data processing and, more particularly, to various techniques to adapt the display characteristics of a display device based, at least in part, on a human perception model that takes into account ambient lighting conditions around the display device, as well as the presence, orientation, and/or type of a privacy element being used in conjunction with the display device (e.g., a detachable privacy screen, etc.).

Today, consumer electronic products having display screens are used in a multitude of different environments with different lighting conditions and may use different types of privacy elements (e.g., the office, the home, home theaters, and outdoors). Some of these consumer electronic products may lack the ability to dynamically adjust their displays such that a viewer's perception of the displayed data remains relatively stable despite changes to the ambient conditions in which the display device is being viewed and/or differences in the types of privacy elements being used in conjunction with the display device.

SUMMARY

The techniques disclosed herein use a display device, in conjunction with: (1) various optical sensors, e.g., one or more ambient light sensors, image sensors, or video cameras, to collect information about the ambient conditions in the environment of a viewer of the display device; and/or (2) various privacy element identification and detection mechanisms (PEDMs), e.g., series of magnets and Hall effect sensors, RFID, resistors, other sensors, or blown fuses, to collect information about the presence, identification, orientation, and/or type of privacy elements being used in conjunction with the display device. The display device may comprise, e.g., a computer monitor, tablet, phone, watch, or television screen. Use of these various optical sensors and PEDMs can provide more detailed information about the ambient lighting conditions in the viewer's environment and/or the presence, orientation, and/or type of privacy elements being used in conjunction with the display device, which a processor in communication with the display device may utilize to create an ambient/privacy model based, at least in part, on the received environmental and privacy element-related information. The ambient/privacy model is also referred to herein as a view model. The ambient/privacy model may be used to enhance or adjust one or more properties of the display device accordingly (e.g., reflectivity, brightness, white point, black point, black leakage, field of view, tone response curve, color offset, etc.), such that the viewer's perception of the content displayed on the display device is relatively independent of the ambient conditions in which the display is being viewed and/or the privacy elements being used in conjunction with the display device (if so desired). In one embodiment, the view model (or ambient/privacy model) is used to enhance or adjust one or more properties of the display device based on at least one of the following: (i) the ambient conditions in which the display is being viewed; or (ii) the privacy elements being used in conjunction with the display device. The ambient/privacy model may be a function of gamma, black point, white point, privacy element orientation and/or type, backlighting, field of view, number of viewers, color offset, or a combination thereof.

When an author creates graphical content (e.g., video, image, painting, etc.) on a given display device, he or she picks colors as is appropriate and may fine tune characteristics, such as hue, tone, contrast until they achieve the desired result. The author's device's ICC profile may then be used as the content's profile—specifying how the content was authored to look, i.e., the author's "intent." This profile may then be attached to the content in a process called tagging. Alternately, the author may create graphical content in an application that performs a color space conversion to the author's chosen target color space, thereby both limiting the composition to colors in that chosen color space and accurately representing what the composition will appear like on a display of that color space (often the sRGB is used). The content may then be processed before displaying it on a consumer's display device (which likely has different characteristics than the author's device) by performing a mapping between the source device's color profile and the destination device's color profile—a process often referred to as "color mapping" or "color management."

However, human perception is not absolute, but rather relative; a human's perception of a displayed image changes based on what surrounds that image. A display may commonly be positioned in front of a wall. In this case, the ambient lighting in the room (e.g., brightness and color) could illuminate the wall behind the monitor and change the viewer's perception of the image on the display. Alternately or additionally, there may be other factors that contribute to the user's perception of the display, such as a window open to bright mid-day sunlight next to the display. This change in perception includes a change to tonality (which may be modeled using a gamma function) and white point.

As mentioned above, a human's perception of a displayed image may also change based on the presence, orientation, and/or type of privacy elements being used in conjunction with the display device. A privacy element, such as a detachable privacy screen or anti-glare screen, may commonly be positioned over a display, e.g., by the use of an adhesive substance around the perimeter of the privacy element that adheres to a border region of the display.

According to some embodiments disclosed herein, the display device may be adapted to automatically allow for the detection of and adaptation for the presence of one or more privacy elements, such as privacy screens. The privacy screens in such scenarios could be adapted to use magnets to easily and unobtrusively attach to the display devices without the need to glue plastic stays (or the like) to the display device around the perimeter of the display. According to some such embodiments, the presence, strength, orientation, or polarity of magnets in the privacy screens could be read by one or more of the PEDMs (e.g., one or more Hall effect sensors, other mechanism, etc.) embedded in the display device, e.g., around the perimeter of the display, to detect a unique ID that may then be used as an index into a database or other mechanism that identifies the exact privacy screen type and characteristics of the determined privacy screen type with regard to the display device. In at least one embodiment, the one or more PEDMs may be used to determine the exact privacy screen type and characteristics of the determined privacy screen type with regard to the display device. This data can also be acquired from or stored on a data store (e.g., cloud-based storage, etc.) that is communicatively coupled to the one or more PEDMs.

A combined ambient/privacy display adaptation model (also referred to herein as, simply: "ambient/privacy model" or "view model") could then use this information (or an index to a database of such information) to perform adaptation to a display with such a privacy screen (in terms of brightness, reflectivity, etc.) and further could adapt for any color shifting introduced by the privacy screen. Further, the ambient/privacy model could adapt the ambient light sensor, and even the display device's camera results to potentially account for being filtered through the privacy screen. Even without a mechanism for automatically identifying the particular type of privacy element present, the ambient/privacy model could be further extended to incorporate a database of common display privacy elements for a user to select from among, or provide a user interface (UI) that would allow the user to tune the display to appear correct with the particular type of privacy screen currently being used in conjunction with the display device.

In one embodiment disclosed herein, information is received from one or more optical sensors, e.g., an ambient light sensor, an image sensor, or a video camera, and the display device's characteristics are determined using sources such as the display device's Extended Display Identification Data (EDID) or ICC profile. Next, information is received from one or more privacy element identification and detection mechanisms (PEDMs), e.g., Hall effect sensors, to collect information about the presence, orientation, and/or type of privacy elements being used in conjunction with the display device. Next, an ambient/privacy model predicts the effect on a viewer's perception due to ambient environmental conditions and/or the privacy elements being used in conjunction with the display device. In one embodiment, the privacy/ambient model may then be used to determine how the values stored in a LUT should be modified to account for the effect that the environment and/or privacy elements are currently having on the viewer's perception. For example, the modifications to the LUT may add or remove gamma or modify the black point or white point of the display device's tone response curve. Additionally, the ambient/privacy model may adjust the display's reflectivity, brightness, field of view, etc., or perform some combination of the options listed above, before sending the image data to the display.

In another embodiment, the ambient/privacy model may be used to apply gamma adjustment or modify the black point or white point of the display device during a color adaptation process, which color adaptation process is employed to account for the differences between the source color space and the display color space.

In other embodiments, a front-facing image sensor, that is, an image sensor facing in the direction of a viewer of the display device, or back-facing image sensor, that is, an image sensor facing away from a viewer of the display device, may be used to provide further information about the "surround" and, in turn, how to adapt the display device's gamma to better account for effects on the viewer's perception. In yet other embodiments, both a front-facing image sensor and a back-facing image sensor may be utilized to provide richer detail regarding the ambient environmental conditions.

In yet another embodiment, a video camera may be used instead of image sensors. A video camera may be capable of providing spatial information, color information, field of view information, information regarding the number of current viewers of the display, as well as intensity information. Thus, utilizing a video camera could allow for the creation of an ambient/privacy model that could adapt not only the gamma, and black point of the display device, but also the white point, reflectivity, brightness, and/or field of view of the display device. This may be advantageous due to the fact that a fixed white point system is not ideal when displays are viewed in environments of varying ambient lighting levels and conditions. E.g., in dusk-like environments dominated by golden light, a display may appear more blueish, whereas, in early morning or mid-afternoon environments dominated by blue light, a display may appear more yellowish. Thus, utilizing a sensor capable of providing color information would allow for the creation of an ambient model that could automatically adjust the white point of the display. Moreover, it may be advantageous for the ambient/privacy model to "infer" times when the device should be placed into a "PRIVATE" mode, e.g., if it is detected that the user is traveling, using public transportation, in a public meeting, in a private meeting, at work, at home, or that more than one human face is currently in the field of view of the front-facing video camera, etc. A "PRIVATE" mode may entail a mode where, due to changes in backlighting, field of view, black point, etc., it is much more difficult for a viewer (other than the user of the device) to be able to read/view what is being shown on the display screen. "PRIVATE" mode may change the behavior of the system in addition to adapting the display for being viewed through the privacy screen. "PRIVATE" mode behavioral changes might include: suppression or reduction in the content of notifications, muting or attenuation of sounds, hiding of desktop or non-active applications, reduction of contrast (to enhance the effectiveness of the privacy filter), disabling of cameras, etc. "PRIVACY" mode may also be signaled by the orientation of the privacy screen (e.g., if the privacy screen is oriented with an opaque tab over a device camera then the device may enable "PRIVACY" selection A, whereas, if the privacy screen in oriented with an opaque tab not over a device camera, then the device may enable "PRIVACY" selection B instead. The "PRIVACY" mode could also be selected via system's UI, such as a settings/preferences panel, menu bar, or control/notification center.

In still another embodiment, an ambient/privacy element-aware dynamic display adjustment system could perform facial detection and/or facial analysis by locating the eyes of a detected face and determining the distance from the display to the face as well as the viewing angle of the face to the display. These calculations could allow the ambient model to determine, e.g., how much of the viewer's view is taken up by the device display and/or whether other people (i.e., not the recognized user/owner of the display device) are attempting to look at the display. Further, by determining what angle the viewer is at with respect to the device display, a Graphics Processing Unit (GPU)-based transformation may be applied to further tailor the display characteristics to the viewer, leading to a more accurate depiction of the source author's original intent and/or a field of view/viewability setting that is tailored for the recognized user/owner of the display device.

Because of innovations presented by the embodiments disclosed herein, the ambient/privacy element-aware dynamic display adjustment techniques that are described herein may be implemented directly by a device's hardware and/or software with little additional computational costs, thus making the techniques readily applicable to any number of electronic devices, such as mobile phones, personal data assistants (PDAs), portable music players, monitors, televisions, as well as laptop, desktop, and tablet computer screens.

Other advantages and/or embodiments are evident in the following detailed description and the accompanying drawings.

DETAILED DESCRIPTION

Figure 1:
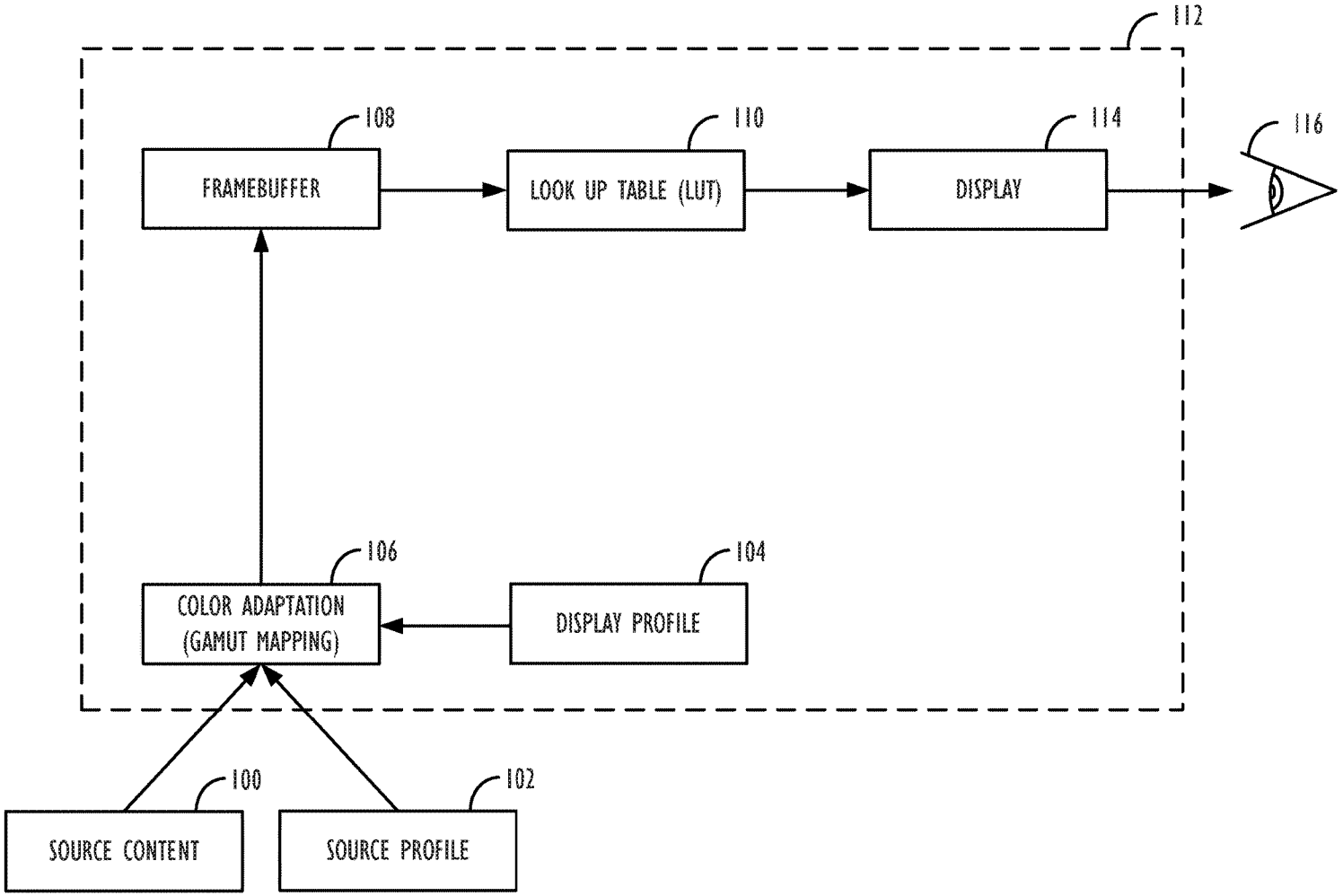
FIG. 1 (PRIOR ART)
FIG. 1 illustrates a system for performing gamma adjustment utilizing a look up table in accordance with the prior art.

This disclosure pertains to techniques for using a display device in conjunction with: (1) various optical sensors (e.g., an ambient light sensor, an image sensor, or a video camera, etc.) to collect information about the ambient conditions in the environment of a viewer of the display device; and/or (2) various privacy element identification and detection mechanisms (PEDMs)—e.g., Hall effect sensors, other sensors, etc.—to collect information about the presence, orientation, and/or type of privacy elements being used in conjunction with the display device in order to create an ambient/privacy model. The ambient/privacy model is also referred to herein as a view model. In one embodiment, the ambient/privacy model is used to enhance or adjust one or more properties of the display device based on at least one of the following: (i) the ambient conditions in which the display is being viewed; or (ii) the privacy elements being used in conjunction with the display device. The ambient/privacy model may be a function of gamma, black point, white point, privacy element orientation and/or type, backlighting, field of view, number of viewers, color offset, or a combination thereof.

This disclosure discusses techniques for creating ambient/privacy element-aware models to dynamically adjust a device display so as to present a consistent visual experience across various environments in which the display is being viewed and/or with respect to the various privacy elements that may be being used in conjunction with the display device. One of ordinary skill in the art would recognize that the techniques disclosed may also be applied to other contexts and applications as well. The techniques disclosed herein are applicable to any number of electronic devices with optical sensors and displays that are amenable to being utilized in conjunction with privacy elements. Illustrative privacy elements include, but are not limited to, digital cameras, digital video cameras, mobile phones, personal data assistants (PDAs), portable music players, monitors, televisions, and, of course, desktop, laptop, and tablet computer displays.

In the interest of clarity, not all features of an actual implementation are described in this specification. It will of course be appreciated that in the development of any such actual implementation (as in any development project), numerous decisions must be made to achieve the developers' specific goals (e.g., compliance with system- and business-related constraints), and that these goals will vary from one implementation to another. It will be appreciated that such development effort might be complex and time-consuming, but would nevertheless be a routine undertaking for those of ordinary skill having the benefit of this disclosure. Moreover, the language used in this disclosure has been principally selected for readability and instructional purposes, and may not have been selected to delineate or circumscribe the inventive subject matter, resort to the claims being necessary to determine such inventive subject matter. Reference in the specification to "one embodiment" or to "an embodiment" means that a particular feature, structure, or characteristic described in connection with the embodiments is included in at least one embodiment of the invention, and multiple references to "one embodiment" or "an embodiment" should not be understood as necessarily all referring to the same embodiment.

Referring now to FIG. 1, a prior art system 112 for performing gamma adjustment utilizing a Look Up Table (LUT) 110 is shown. Element 100 represents the source content that viewer 116 wishes to view. Source content 100 may be created, for example, by a source content author. Source content 100 may comprise an image, video, graphic, text, or other displayable content type. Element 102 represents the source profile, which is information describing the color profile and display characteristics of the device on which source content 100 was authored by the source content author. Source profile 102 may comprise, e.g., an ICC profile of the author's device or color space, or other related information. An ICC profile is a set of data that characterizes a color input or output device, or a medium, according to standards promulgated by the International Color Consortium (ICC). ICC profiles may describe the color attributes of a particular device or viewing requirement by defining a mapping between the device source or target color space and a profile connection space (PCS), usually the CIE XYZ color space. ICC and International Color Consortium are trademarks of the International Color Consortium.

As is known in technology fields related to display devices and human perception modeling, the use of gamma encoding maps linear display data (e.g., source content 100) into a more perceptually uniform domain. Gamma adjustment, or, as it is often simply referred to, "gamma," is the name given to the nonlinear operations commonly used to encode linear luma values. Gamma, γ, may be defined by the following simple power-law expression: $L_{out}=L_{in}^{\gamma}$, where the input and output values, $L_{in}$ and $L_{out}$, respectively, are typically non-negative real values occurring over a predetermined range, e.g., zero to one. A gamma value greater than one is sometimes called an encoding gamma, and the process of encoding with this compressive power-law nonlinearity is called gamma compression. Conversely, a gamma value less than one is sometimes called a decoding gamma, and the application of the expansive power-law nonlinearity is called gamma expansion.

In some scenarios, e.g., in "extended range" representations, negative values may also be used (both in the linear and gamma-encoded "spaces") to encode colors that are outside of the nominal gamut defined by the usual primaries used to describe a color space (e.g., a color more saturated than a logical sum of the primaries may be mathematically represented as a color with one or more—but not all—components negative). For instance, to make a more saturated than 1,0,0 sRGB red, one could remove some of the sRGB red color's green and/or blue "pollution" using negative green and/or negative blue component values. The matrix math used to translate colors between color spaces will automatically generate values outside of the nominal (0,1) range, but they are usually truncated. Values greater than 1.0 may also represent higher dynamic range values.

Another way to think about the gamma characteristic of system 112 is as a power-law relationship that approximates the relationship between the encoded luma in the system 112 and the actual desired image luminance on whatever the eventual user display device is (e.g., display 114). Other uses of gamma may include: encoding between the physical world and media; decoding media data to linear space; and converting display linear data to the display's response space.

Information relating to the source content 100 and source profile 102 may be sent to viewer 116's device containing the system 112 for performing gamma adjustment utilizing a LUT 110. Viewer 116's device may comprise, for example, a mobile phone, PDA, portable music player, monitor, television, or a laptop, desktop, or tablet computer. Upon receiving the source content 100 and source profile 102, system 112 may perform a color adaptation process 106 on the received data, e.g., utilizing the COLORSYNC® framework. (COLORSYNC® is a registered trademark of Apple Inc.) COLORSYNC® provides several different techniques to perform gamut mapping, i.e., color matching across various color spaces. For instance, perceptual matching tries to preserve as closely as possible the relative relationships between colors, even if all the colors must be systematically distorted.

Once the color profiles of the source and destination have been appropriately adapted, image values (e.g., red, green, and blue pixel values or luma values, etc.) may enter the framebuffer 108. The framebuffer 108 may be defined as a video output device that drives a video display from a memory buffer containing a complete frame of, in this case, image data of source content 100 that is processed using the process 106. In system 112, a computer processor or other suitable programmable control device (not shown) may perform gamma adjustment computations for display device 114 based on the native luminance response (often called the "EOTF," or electrical optical transfer function) of the display device 114, the color gamut of the display device 114, and white point information associated with the display device 114 (that may be stored in the source profile 102), as well as the source profile 102 attached to the source content 100 to specify the content's "rendering intent."

As explained above, the image values of the source content 100 entering framebuffer 108 may already have been processed by the color adaptation process 106 and/or one or more applications (not shown). These images values may have a specific implicit gamma that is based on a Framebuffer Gamma function, as will be described in more detail below. In some scenarios, the image values may need to be converted into linear space so that additional operations may be performed on the data before the data is inverted back to non-linear space for display. In other scenarios, the image values may undergo linear space scaling, color space conversion, and/or compositing before entering framebuffer 108. In still other scenarios, some operations may also be performed on the image values after exiting the framebuffer 108. For example, a color space conversion may be used to convert image values from a canonical framebuffer color space to a specific color space of the display, e.g., a "panel fit" scale.

System 112 may then utilize a "Look Up Table" (LUT) 110 to perform a so-called "gamma adjustment process." The implicit gamma of the values entering the framebuffer 108 can be visualized by looking at a "Framebuffer Gamma Function" that is ideally an inverse of a "Native Display Response" function associated with the display device 114. The Native Display Response Function can be used to characterize the luminance response of the display 114 to input, to yield unity system response. However, because the inverse of the Native Display Response isn't always exactly the inverse of the framebuffer, the LUT 110—sometimes implemented on a processing unit (e.g., a GPU)—may be used to transform the data in order to accommodate imperfections in the relationship between the encoding gamma and decoding gamma values, as well as the particular luminance response characteristics of the display device 114.

LUT 110 may comprise a two-column table of positive, real values spanning a particular range, e.g., from zero to one. First column values may correspond to an input image value, whereas the corresponding second column values may correspond to an output image value that the input image value will be "transformed" into before being ultimately being displayed on display 114. LUT 110 may be used to account for the imperfections in the display 114's luminance response curve, also known as a transfer function, or "EOTF." In other scenarios, an LUT may have separate channels for each primary color in a color space, e.g., an LUT may have Red, Green, and Blue channels in the sRGB color space.

In some scenarios, the goal of gamma adjustment system 112 is to have an overall 1.0 gamma boost applied to the content that is being displayed on the display device 114. An overall 1.0 gamma boost corresponds to a linear relationship between the input encoded luma values and the output luminance on the display device 114. Ideally, an overall 1.0 gamma boost will correspond to the source author's intended view of the content presented on the display device 114.

The transformation applied by the LUT 110 to the data from framebuffer 108 before the data is output to the display device 114 ensures the desired 1.0 gamma boost on the eventual display device 114. This is generally a good outcome, although it does not take into account the effect on the viewer 116's perception of gamma due to differences in ambient light conditions. In other words, the 1.0 system gamma boost may only appropriate in one ambient lighting environment. Furthermore, the transformation applied by the LUT 110 to the data from framebuffer 108 before the data is output to the display device 114 does not take into account the effect on the viewer 116's perception of gamma due to the presence of one or more privacy elements (not shown) being used in conjunction with the display device 114. Examples of privacy elements includes, but are not limited to, a detachable privacy screen, anti-glare filter, or similar overlay.

Figure 2:
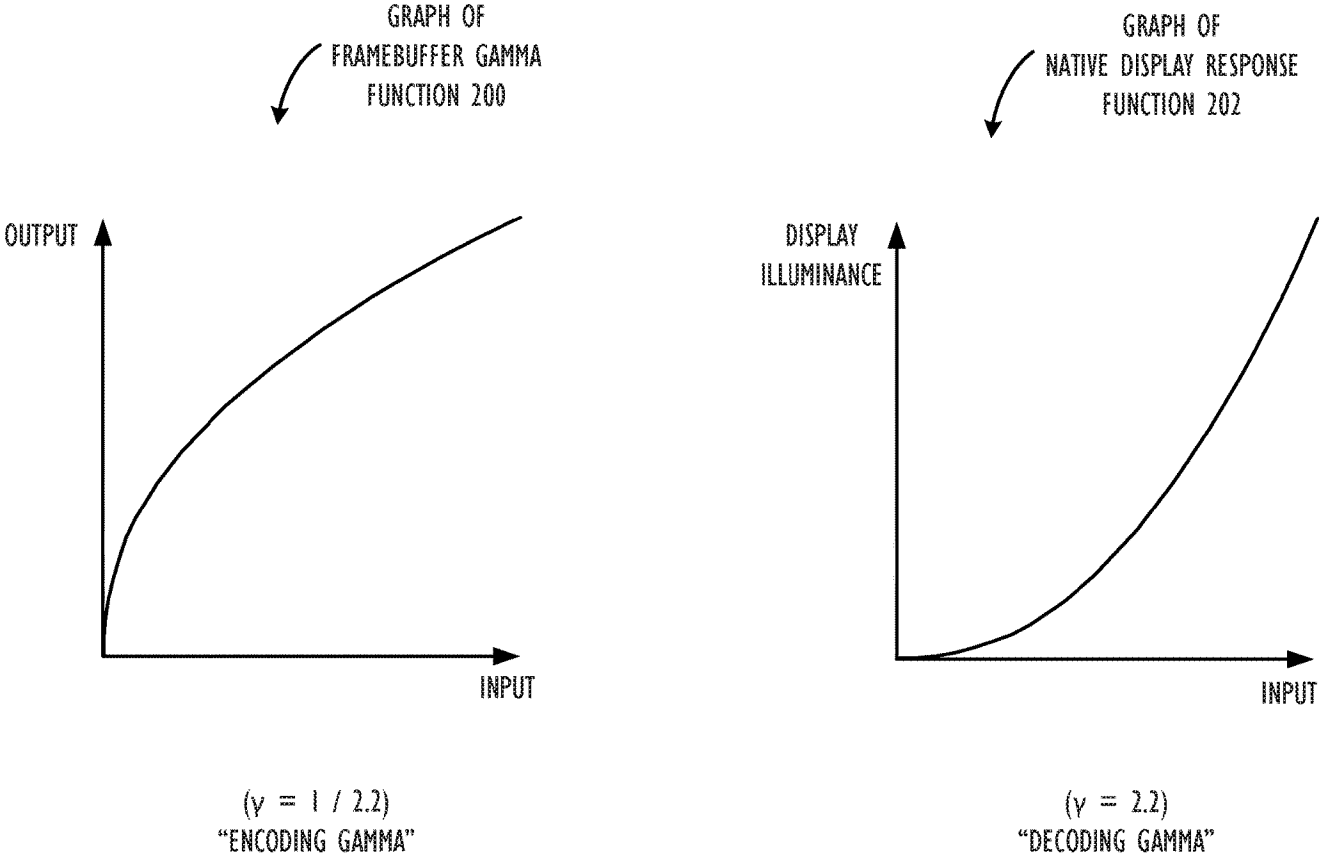
FIG. 2 (PRIOR ART)
FIG. 2 illustrates a graph of a Framebuffer Gamma Function and a graph of an exemplary Native Display Response in accordance with the prior art.

Referring now to FIG. 2, a graph of a Framebuffer Gamma Function 200 and an exemplary graph of a Native Display Response 202 is shown. Graphs 200 and 202 of FIG. 2 are described in connection with FIG. 1 (which is described above). With regard to graph 200, the abscissae on the horizontal axis of the graph of the Framebuffer Gamma Function 200 represent input image values spanning a particular range, e.g., from zero to one. The ordinates on the vertical axis of the graph of the Framebuffer Gamma Function 200 represent output image values spanning a particular range, e.g., from zero to one. As mentioned above, in some scenarios, image values may enter the framebuffer 108 already having been processed and have a specific implicit gamma. As shown in graph 200 in FIG. 2, the encoding gamma is roughly 1/2.2 or 0.45. That is, the line in graph 200 roughly looks like the function, $L_{OUT}=L_{IN}^{0.45}$. Gamma values around 1/2.2 are typically used as encoding gammas because the native display response of many display devices have a gamma of roughly 2.2, that is, the inverse of an encoding gamma of 1/2.2.

With regard to the graph 202, the abscissae on the horizontal axis of the graph of the Native Display Response Function 202 represent input image values spanning a particular range, e.g., from zero to one. The ordinates on the vertical axis of the graph of the Native Display Response Function 202 represent output image values spanning a particular range, e.g., from zero to one. In theory, systems (e.g., the system 112 in FIG. 1) in which the decoding gamma is the inverse of the encoding gamma should produce the desired overall 1.0 gamma boost. However, this does not take into account the effect on the viewer due to ambient light in the environment around the display device and/or the presence of privacy elements being used in conjunction with the display device. Thus, the desired overall 1.0 gamma boost may only be achieved in certain ambient lighting environment conditions and with no privacy elements being used in conjunction with the display device.

Figure 3:
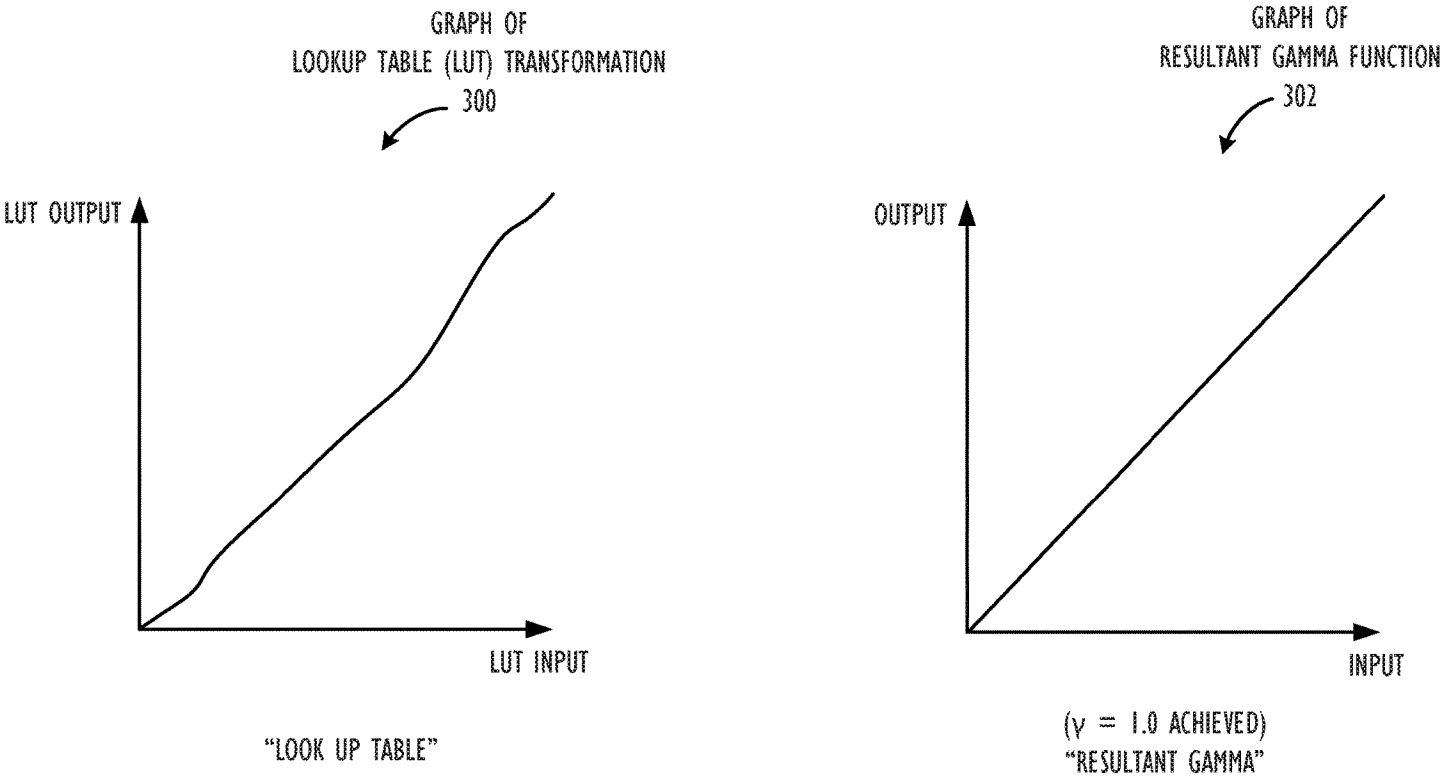
FIG. 3 (PRIOR ART)
FIG. 3 illustrates a graph of a LUT transformation and a graph of a Resultant Gamma Function in accordance with the prior art.

Referring now to FIG. 3, a graphical representative of an LUT transformation 300 and a graphical representation of a Resultant Gamma Function 302 are shown. Graphs 300 and 302 are described in connection with FIGS. 1 and 2 (which are described above). The graphs 300 and 302 in FIG. 3 show one example of how an LUT (e.g., the LUT 110 of FIG. 1) may be utilized to account for the imperfections in the relationship between the encoding gamma and decoding gamma values, as well as the particular luminance response characteristics of a display device at different input levels (e.g., the particular luminance response characteristics of the display device 114 in FIG. 1 at different input levels). In graph 300, the abscissae on the horizontal axis represent input image values spanning a particular range, e.g., from zero to one. The ordinates on the vertical axis of LUT graph 300 represent output image values spanning a particular range, e.g., from zero to one. The graph of the Resultant Gamma Function 302 reflects a desired overall 1.0 gamma boost resulting from the gamma adjustment provided by the LUT. The abscissae on the horizontal axis of the graph of the Resultant Gamma Function 302 represent input image values as authored by the source content author spanning a particular range, e.g., from zero to one. The ordinates on the vertical axis of the graph of the Resultant Gamma Function 302 represent output image values displayed on the resultant display spanning a particular range, e.g., from zero to one. The slope of 1.0 reflected in the line in graph 302 indicates that luminance levels intended by the source content author will be reproduced at corresponding luminance levels on the ultimate display device.

Figure 4:
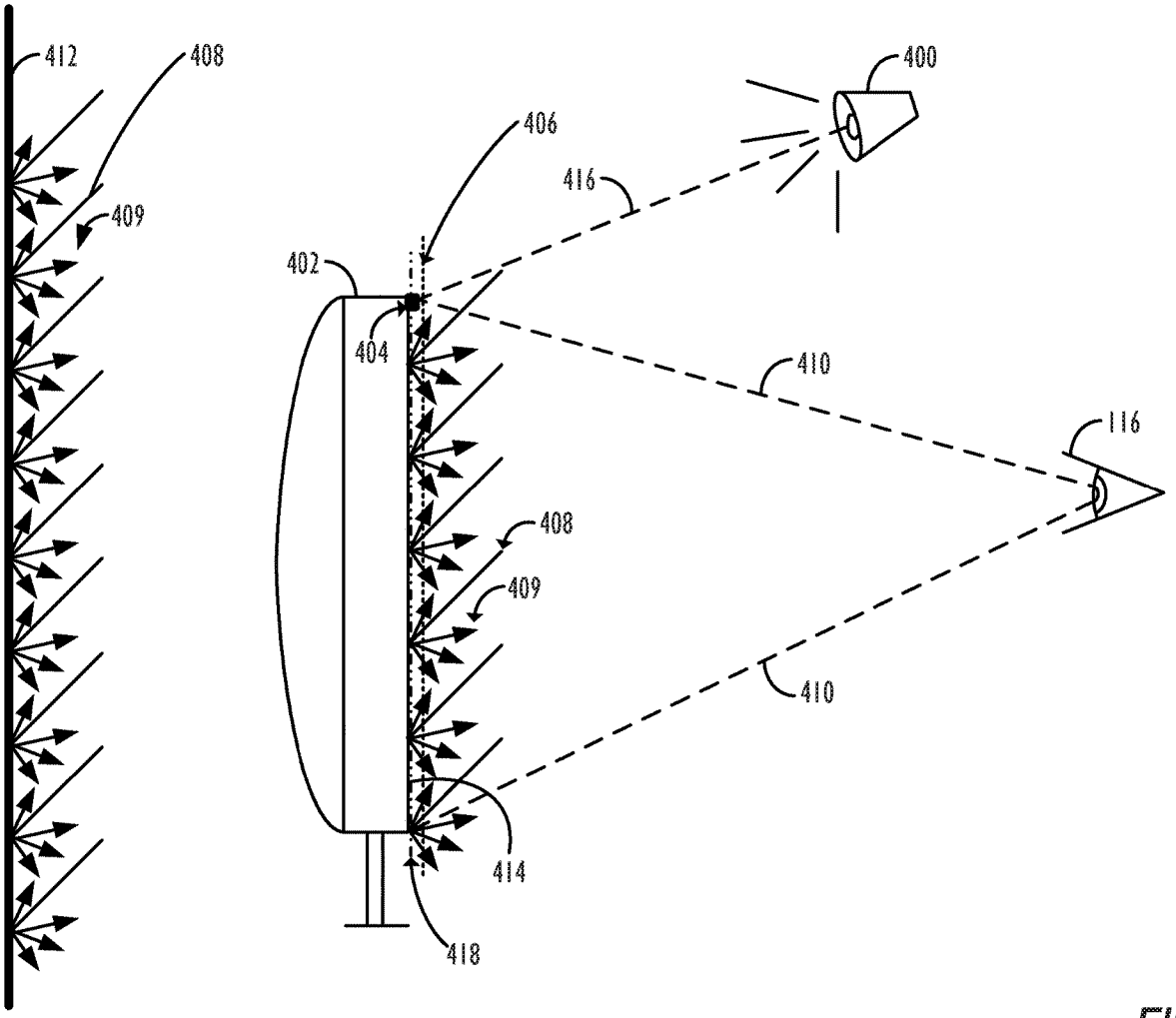
FIG. 4 illustrates the properties of ambient lighting and diffuse reflection off a display device in accordance with one embodiment.

Referring now to FIG. 4, the properties of ambient lighting and diffuse reflection off a display device are shown via the depiction of a side view of a viewer 116 of a display device 402 in a particular ambient lighting environment. As shown in FIG. 4, viewer 116 is looking at display device 402, which, in this case, is a typical desktop computer monitor. A privacy screen, illustrated by dashed line 418, is shown as being adhered closely to the display surface 414 of display device 402. Dashed lines 410 represent the viewing angle of viewer 116. The ambient environment as depicted in FIG. 4 is lit by environmental light source 400, which casts light rays 408 onto all of the objects in the environment, including wall 412, as well as the display surface 414 of display device 402. As shown by the multitude of small arrows 409 (representing reflections of light rays 408), a certain percentage of incoming light radiation will reflect back off of the surface that it shines upon.

One phenomenon in particular, known as diffuse reflection, may play a particular role in a viewer's perception of a display device. Diffuse reflection may be described as the reflection of light from a surface such that an incident light ray is reflected at many angles. Thus, one of the effects of diffuse reflection is that, in instances where the intensity of the diffusely reflected light rays is greater than the intensity of light projected out from the display in a particular region of the display, the viewer will not be able to perceive tonal details in those regions of this display. This effect is illustrated by dashed line 406 in FIG. 4. Namely, light emitted from the display surface 414 of display device 402 that has less intensity than the diffusely reflected light rays 409 will not be able to be perceived by viewer 116. Privacy screen 418 may also affect the intensity of diffusely reflected light rays 409, and the subsequent ability of the viewer 116 to perceive light emitted from the display surface 414 of display device 402. Thus, in one embodiment disclosed herein, an ambient/privacy element-aware model for dynamically adjusting a display's characteristics may reshape the tone response curve for the display such that the most dimly displayed colors don't become indiscernible to the viewer. Such dimly displayed colors may be caused by either the privacy screen 418 or the predicted diffuse reflection levels from the display surface 414. Further, there is more diffuse reflection off non-glossy displays than there is off glossy displays, and the ambient/privacy model may be adjusted accordingly for display type. The predictions of diffuse reflection levels input to the ambient/privacy model may be based off light level readings recorded by one or more optical sensors, e.g., sensor 404. Dashed line 416 represents data indicative of the light source being collected by optical sensor 404. Optical sensor 404 may be used to collect information about the ambient conditions in the environment of the display device and may comprise, e.g., an ambient light sensor, an image sensor, or a video camera, or some combination thereof. Optical sensor 404 may also be used to collect information about the presence, orientation, and/or type of privacy elements being used in conjunction with the display device, e.g., in scenarios where the field of view of the optical sensor 404 may be partially or completely blocked by the presence of a privacy screen 418. In other embodiments, optical sensor 404 may also be used to recognize when a user has put something (e.g., a cloth or a piece of paper) over the screen of the display device and, in response, place the display into a "PRIVATE" mode. This may also be accomplished by measuring, e.g., a light level coming from a keyboard as the lid of a laptop device is opened (this reading could provide a reference so that it is possible to determine if something is subsequently placed over the camera or other ambient sensor).

A front-facing image sensor provides information regarding how much light is hitting the display surface. This information may be used in conjunction with a model of the reflective and diffuse characteristics of the display to determine where the black point is for the particular lighting conditions the display is currently in. Although optical sensor 404 is shown as a "front-facing" image sensor, i.e., facing in the general direction of the viewer 116 of the display device 402, other optical sensor placements and positioning are possible. For example, one or more "back-facing" image sensors alone (or in conjunction with one or more front facing sensors) could give even further information about light sources and color in the viewer's environment. The back-facing sensor picks up light re-reflected off objects behind the display and may be used to determine the brightness of the display's surroundings. This information may be used to adapt the display's gamma function. For example, the color of wall 412, if it fills enough of the viewer's field of vision 402 could have a profound effect on the viewer's perception. Likewise, in the example of an outdoor environment, the color of light surrounding the viewer can make the display appear differently than it would in an indoor environment with neutral colored lighting.

In one embodiment, the optical sensor 404 may comprise a video camera capable of capturing spatial information, color information, and intensity information. Thus, utilizing a video camera could allow for the creation of an ambient model that could adapt not only the gamma and black point of the display device, but also the display device's white point. This may be advantageous because fixed white point systems are not generally ideal when displays are viewed in environments of varying ambient lighting levels and conditions. In some embodiments, a video camera may be configured to capture images of the surrounding environment for analysis at some predetermined time interval, e.g., every ten seconds, thus allowing the ambient/privacy model to be gradually updated as the ambient conditions (including the presence, or lack thereof, of a privacy element) in the viewer's environment change (causing the viewer's perception to change). The rate of adaptation ideally should match the rate of the viewer's perceptual adaptation (perceptual adaptation is asymmetric with respect to environmental brightening or darkening).

Additionally, a back-facing video camera intended to model the surroundings could be designed to have a field of view roughly consistent with the calculated or estimated field of view of a viewer. Once the field of view of the viewer is calculated or estimated—e.g., based on the size or location of the viewer's facial features as recorded by a front-facing camera, assuming the native field of view of the back-facing camera is known and is larger than the field of view of the viewer—the system may then determine what portion of the back-facing camera image to use for updating the ambient/privacy model. This "surround cropping" technique may also be applied to the white point computation for the viewer's surroundings.

Figure 5:
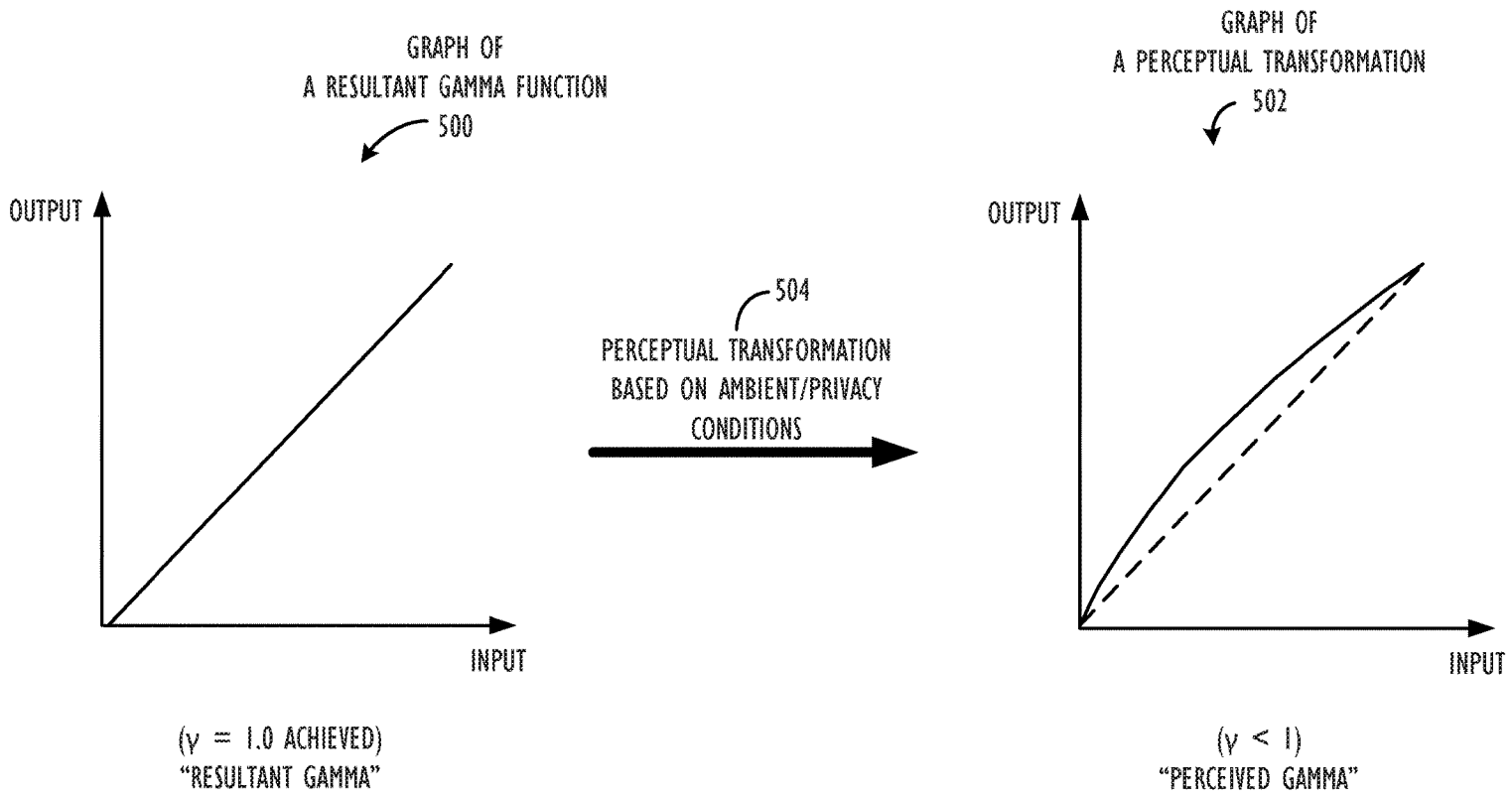
FIG. 5 illustrates a graph of a Resultant Gamma Function and a graph of a perceptual transformation in accordance with one embodiment.

Referring now to FIG. 5, a graph of a Resultant Gamma Function 500 and a graph indicative of a perceptual transformation 502 caused by ambient/privacy conditions are shown. As mentioned above in reference to graph 302 in FIG. 3, ideally, the Resultant Gamma Function 500 reflects a desired overall 1.0 gamma boost on the resultant display device. The slope of 1.0 reflected in the line in graph 500 indicates that the response curves (i.e., gamma) are matched between the source and the display and that the image on the display is likely being displayed more or less as the source's author intended. However, this calculated overall 1.0 gamma boost does not take into account the effect on the viewer's perception due to differences in ambient light conditions and/or the presence of privacy elements. In other words, due to perceptual transformations that are caused by ambient conditions in the viewer's environment (including the presence of privacy elements) 504, the viewer does not perceive the desired overall 1.0 gamma boost in all lighting conditions. As is shown in graph 502, the dashed line indicates an overall 1.0 gamma boost, whereas the solid line indicates the viewer's actual perception of gamma, which corresponds to an overall gamma boost that is not equal to 1.0. Thus, an ambient-aware model for dynamically adjusting a display's characteristics according to embodiments disclosed herein may be able to account for the perceptual transformation based on the viewer's ambient conditions (including the presence of privacy elements) and present the viewer with what he or she will perceive as the desired overall 1.0 gamma boost.

Figure 6A:
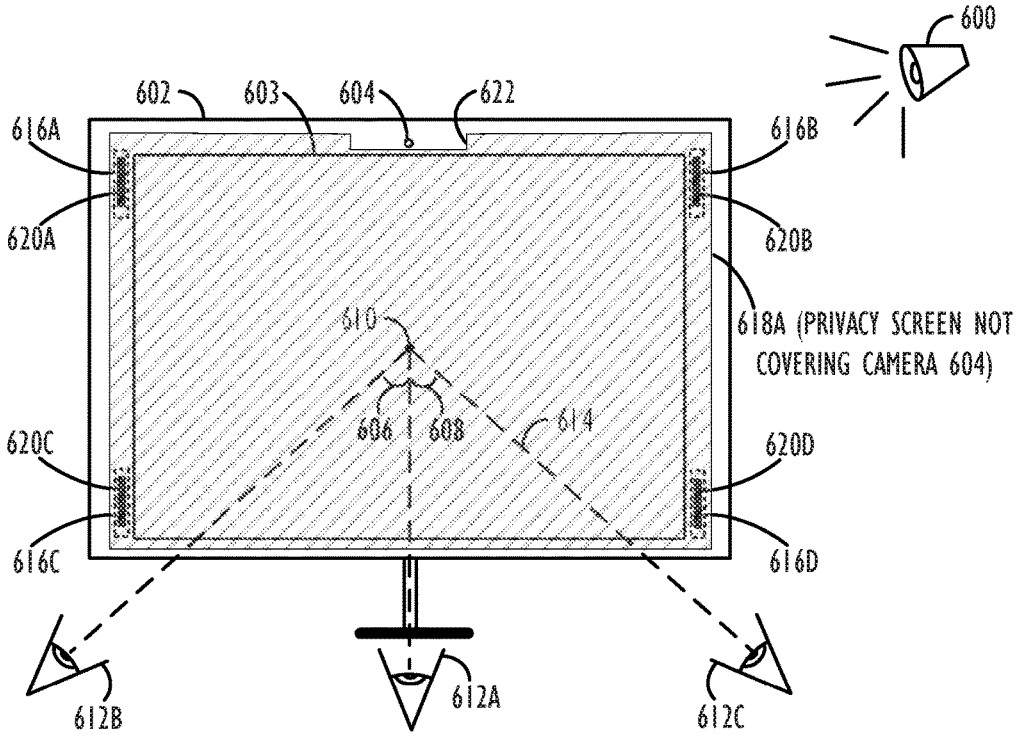
FIGS. 6A and 6B illustrate exemplary orientations of a privacy element with respect to a display device configured to detect and adapt to the presence of the privacy element in accordance with one embodiment.
Figure 6B:
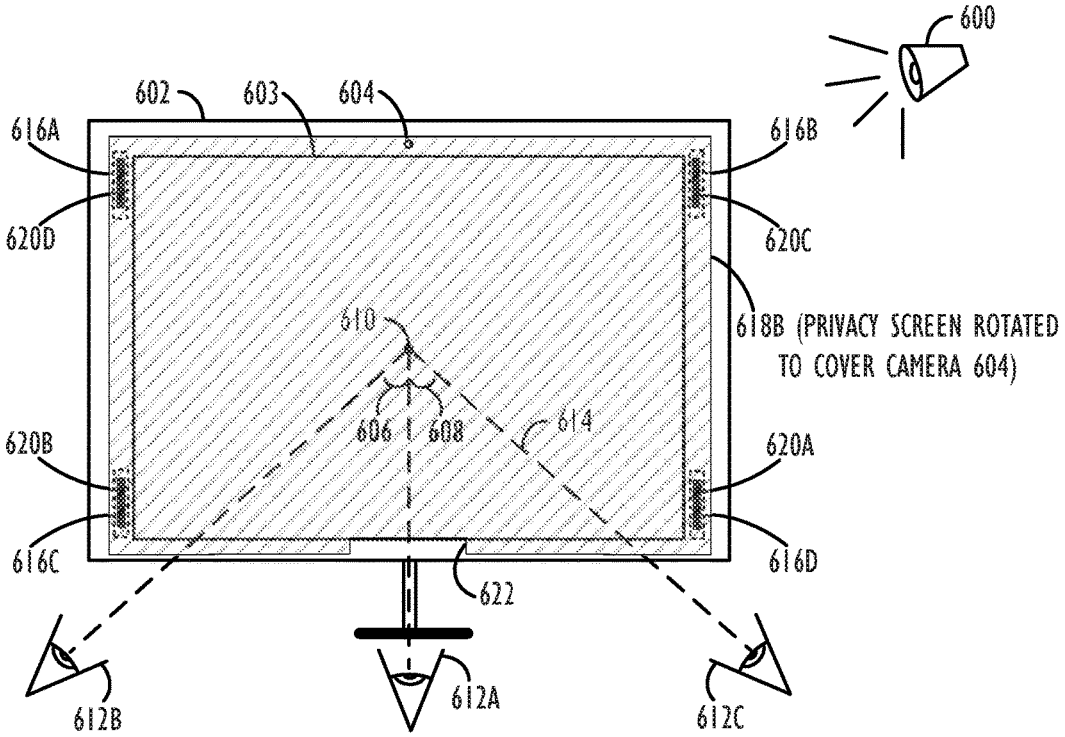

Referring now to FIGS. 6A and 6B, exemplary orientations of a privacy element 618 are shown, with respect to a display device configured to detect and adapt to the presence of said privacy element. Turning first to FIG. 6A, an exemplary display device 602 (e.g., a desktop monitor), having a display surface 603 and a front-facing camera/ambient light sensor 604, is shown in an environment where it is being illuminated by light source 600, and in which it is being viewed by viewers 612A, 612B, and 612C.

Viewers 612A-612C are located at different viewing angles 606/608 to display device 602. Center point 610 represents the center of display device 602. Thus, it can be seen that viewer 612A is at a zero-offset angle from center point 610, whereas viewer 612B is at an offset angle 606 from center point 610, and viewer 612C is at an offset angle 608 from center point 610. For the purposes of this example, viewer 612A will be considered the 'authorized' user/owner of display device 602. In one embodiment, sensor 604 may be an image sensor or video camera capable of performing facial detection and/or facial analysis by locating the eyes of a particular viewer 612 and calculating the distance 614 from the display to the viewer, as well as the viewing angle 606/608 of the viewer to the display.

These determinations could enable an ambient/privacy element-aware model for dynamically adjusting a display's characteristic to determine how much of the 'authorized' user's view is taken up by the device display. Further, by determining what angle the 'authorized' viewer is at with respect to the device display, a GPU-based transformation may be applied to further tailor the display's characteristics to the 'authorized' viewer's position (e.g., gamma, black point, white point). All of this can lead to a more accurate depiction of the source author's original intent and an improved and consistent viewing experience for the 'authorized' viewer, potentially at the expense of the viewing conditions for 'unauthorized' viewers 612B and 612C, as shown in the example of FIG. 6A.

Also shown as part of the exemplary display device 602 of FIG. 6A are four privacy element identification and detection mechanisms (PEDMs) 616A-616D. As shown in FIG. 6A, the four PEDMs 616 (represented by dashed-line rectangles) may be located substantially at the four corners of the display surface 603. In other embodiments, the location of the PEDMs 616 could vary, based on a given implementation and the connective mechanism used to connect the privacy element to the display device. In some embodiments, the PEDMs 616 may comprise Hall effect sensors. In other embodiments, the PEDMs may comprise embedded RFID radios in the display device and corresponding embedded RFID tags in the privacy screens.

In some embodiments, the privacy screen 618A could be adapted to use magnets 620 (represented by solid-black rectangles) to easily and unobtrusively attach to the display device's corresponding embedded magnets located at the respective positions of PEDMs 616A-616D without the need to glue plastic stays (or the like) to the display device around the perimeter of the display (i.e., an 'auto alignment' mechanism). As shown in FIG. 6A, the privacy screen 618A has four magnets 620A-620D that are located substantially at the four corners of the privacy screen 618A, so as to properly align with the PEDMs 616. In other embodiments, the location and type of the connective element 620 used in the privacy screen 618 could vary, based on a given implementation.

According to some embodiments, the magnets 620 in the privacy screen 618 could be read by the Hall effect sensors 616 (or other suitable PEDM) embedded in the display device 602 to detect a unique ID that may then be used as an index into a "privacy element database" that identifies the exact type of privacy screen 618 and one or more characteristics of the privacy screen 618 with regard to the display device 603. The one or more characteristics of the privacy screen 618 with regard to the display device 603 can be referred to herein as "one or more PEDM parameters." For one embodiment, the PEDMs include one or more sensors, one or more RFID tags, and associated circuitry for acquiring reflectance, light loss, white shift (or color shift of white light), field of view, and any other information related to an operation of the privacy screen 618 when it is used with the display device 603. For this embodiment, the unique ID can be associated with the PEDM parameters, such that the determination of the unique ID includes acquiring the PEDM parameters using the PEDMs. For a further embodiment, the PEDMs can include (or be associated with) memory for storing the unique ID and/or the one or more PEDM parameters acquired using the PEDMs. In this way, the unique ID and/or the one or more acquired PEDM parameters can be read directly from the PEDMs. Also, and for an even further embodiment, the unique ID and/or the one or more acquired PEDM parameters can be communicated by the PEDMs to an external data store (e.g., cloud-based storage, a server, etc.) via one or more communication mechanisms (e.g., a network and its corresponding networking equipment, etc.). For another embodiment, the unique ID can be used as an index into the privacy element database to acquire the one or more PEDM parameters from the privacy element database. For this embodiment, the one or more PEDM parameters can be acquired via testing or may be obtained from a manufacturer of the privacy screen 618 and/or a manufacturer of the display device 603. For a further version of the immediately preceding embodiment, the privacy element database can be in an external data store (e.g., cloud-based storage, a server, etc.) that is accessed by the PEDMs via one or more communication mechanisms (e.g., a network and its corresponding networking equipment, etc.).

A combined ambient/privacy model could then use this information (or an index to a database of such information) to perform adaptation to the display that is currently being viewed in conjunction with such a privacy screen (in terms of brightness, reflectivity, white point, black point, field of view, etc.). Such a system could further be adapt to compensate for any color shifting introduced by the privacy screen. Further, the ambient/privacy model could adapt the ambient light sensor, and even the display device's camera results to potentially account for being filtered through the privacy screen. Even without a mechanism for automatically identifying the particular type of privacy element present, the ambient/privacy model could be further extended to incorporate a database of common display privacy elements for a user to select from among, or provide a user interface (UI) that would allow the user to tune the display to appear correct with the particular type of privacy screen currently being used in conjunction with the display device.

Also shown in FIG. 6A is a notch 622 in the top side of privacy screen 618A. According to some embodiments, a notch 622, or other cut-out of a desirable shape or size may be made in privacy screen 618A. In some embodiments, this notching may be done so that, when attached to display device 602, the privacy screen 618A does not block or occlude the field of view of sensor 604. According to some embodiments, a privacy screen attached such that the field of view of the display device's front-facing sensor is not blocked or occluded may be used as an indication that the 'authorized' user does not currently wish to view the device in "PRIVATE" mode. It may be advantageous for the ambient/privacy model to "infer" times when the device should be placed into a "PRIVATE" mode, e.g., if it is detected that the user is traveling, using public transportation, in a public meeting, in a private meeting, at work, at home, or that more than one human face is currently in the field of view of the front-facing video camera, etc. A "PRIVATE" mode may entail a mode where, due to changes in backlighting, field of view, black point, etc., it is much more difficult for a viewer (other than the user of the device) to be able to read/view what is being shown on the display screen. "PRIVATE" mode may change the behavior of the system in addition to adapting the display for being viewed through the privacy screen. "PRIVATE" mode behavioral changes might include: suppression or reduction in the content of notifications, muting or attenuation of sounds, hiding of desktop or non-active applications, reduction of contrast (to enhance the effectiveness of the privacy filter), disabling of cameras, etc. "PRIVACY" mode may also be signaled by the orientation of the privacy screen (e.g., if the privacy screen is oriented with an opaque tab over a device camera then the device may enable "PRIVACY" selection A, whereas, if the privacy screen in oriented with an opaque tab not over a device camera, then the device may enable "PRIVACY" selection B instead. The "PRIVACY" mode could also be selected via system's UI, such as a settings/preferences panel, menu bar, or control/notification center.

Turning now to FIG. 6B, the privacy screen (now 618B) has been rotated 180 degrees, such that the notch 622 is now at the bottom of display device 602, and the sensor 604 is occluded by the privacy screen 618B. (This is also illustrated by the fact that magnets 620A and 620B, as shown in FIG. 6B, now connect with PEDMs 616D and 616C, respectively, at the bottom of display device 602, as opposed to PEDMs 616A and 616B, respectively, as they did when the privacy screen was in the orientation illustrated in FIG. 6A. Likewise, magnets 620D and 620C, as shown in FIG. 6B, now connect with PEDMs 616A and 616B, respectively, at the top of display device 602, as opposed to PEDMs 616D and 616C, respectively, as they did when the privacy screen was in the orientation illustrated in FIG. 6A.) As mentioned above, this "asymmetric" property of the privacy screen 618B may be used to reflect an indication that the 'authorized' user currently wishes to view the device in "PRIVATE" mode (e.g., performing additional or extra display adjustments to make it more difficult for users that are 'off-axis' or farther away from the display screen to be able to read or view the contents being displayed on the screen). Other forms of asymmetry and/or orientation changes of the privacy element may likewise be used to indicate a user's desire for the ambient/privacy model to adjust the device's display according to the user's current situation/environment.

In still other embodiments, the user's indication that the he or she wishes the device to be operating in "PRIVATE" mode may affect other parts of the display device's operating system. For example, the system could go into a "Do Not Disturb" mode where notifications or other events are suppressed or filtered, so that they are not immediately noticeably raised to the user. In yet other embodiments, the display screen itself may be altered to 'simulate' the effects of a privacy screen without a physical privacy screen actually being put in communication with the display device, e.g., by using two independently-controlled LCD devices overlaid one another as part of the display device's display surface.

Figure 7:
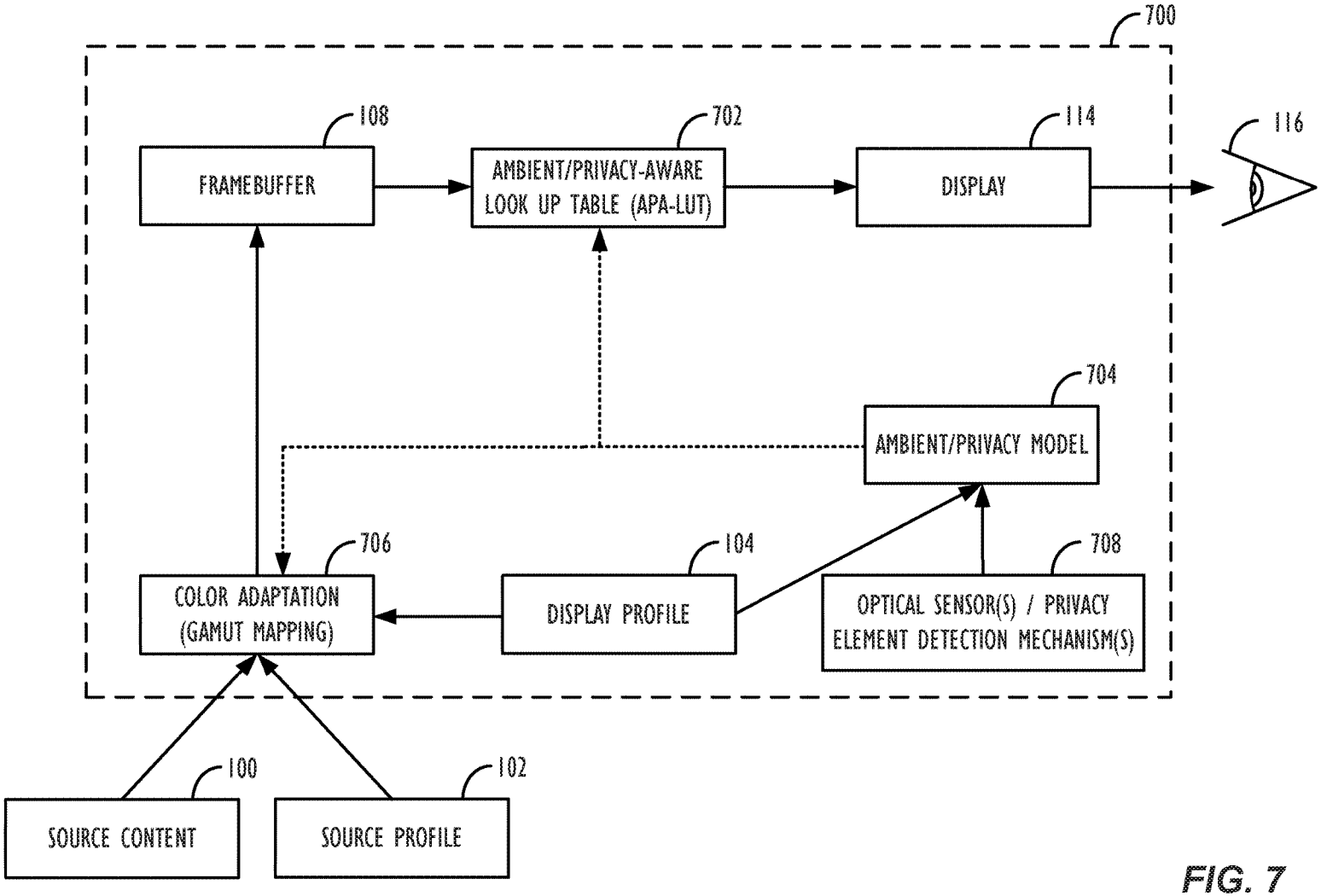
FIG. 7 illustrates a system for performing ambient/privacy element-aware dynamic display adjustment in accordance with one embodiment.

Referring now to FIG. 7, a system 700 for performing gamma adjustment, black point compensation, and/or white point adjustment utilizing an ambient/privacy-aware Look Up Table (APA-LUT) 702 and an ambient/privacy model 704 in accordance with one embodiment is shown. Ambient/privacy model 704 may be used to take information 708 is indicative of ambient light conditions from one or more optical sensors, the presence, orientation, and/or type of privacy elements in conjunction with the display device, as well as information indicative of the display profile 104's characteristics, and utilize such information to predict their effect on the viewer's perception and/or improve the display device's tone response curve for the display device's particular ambient environment/privacy element conditions.

One embodiment of an ambient/privacy element-aware model for dynamically adjusting a display's characteristic disclosed herein takes information from one or more optical sensors (e.g., sensor 404), information regarding the presence, orientation, and/or type of privacy elements in conjunction with the display device, and display profile 104 and makes a prediction such effects have on viewing conditions and the viewer's perception due to such conditions. The result of that prediction may be used to determine how system 700 modifies the LUT, such that it serves as an "ambient/privacy-aware" LUT 702. In one embodiment, LUT modifications may comprise modifications to add or remove gamma from the system or to modify the black point or white point of the system. "Perceptual black" may be described as the level of light intensity below which no further detail may be perceived by a viewer. "White point" may be described as the set of values that serve to define the color "white" in the color space.

In one embodiment, the black level for a given ambient environment may be determined, e.g., by using an ambient light sensor 404 or by taking measurements from the display device's actual panel and/or diffuser. As mentioned above in reference to FIG. 4, diffuse reflection of ambient light off the surface of the device may cause a certain range of the darkest display levels to become indiscernible to the viewer. Generally, ambient light as reflected off the display, as well as backlight that is not stopped by the display at the blackest values combine additively to create a so-called "pedestal." Pedestals does not technically mask display values but rather make all displayed values brighter by the "pedestal" amount. Stated more directly, ambient light as viewed reflected off surfaces changes the user's adaptation. At a given adaptation, the viewer may only be able to discern a certain number of distinct brightness levels (e.g., on the order of between 256 and 512 of non-linear size). These distinct brightness levels that are discernible to the viewer are also referred to herein as "perceptual bins." Once this level of diffuse reflection is determined, the black point may be adjusted accordingly. For example, if all luminance values below an 8-bit value of 40 would be indiscernible to the viewer over the level of diffuse reflection (though this is likely an extreme example), the system 700 may set the black point to be 40, thus compressing the pixel luminance values into the range of 41-255. In one particular embodiment, this "black point compensation" may be performed by "stretching" or otherwise modifying the values in the LUT. This type of adaptation may be needed, e.g., when a viewer is adapting to brightness levels far exceeding the range of the display. Such a situation can cause many of the lowest levels of the display to be compressed into the same "perceptual bin(s)." In such situations, there may be a need to "re-curve" the display to at least optimize the display to the perceptual bins that are available in its current brightness range (i.e., taking the pedestal into account).

In another embodiment, the white point for a given ambient environment may be determined, e.g., by using an image sensor or video camera to determine the white point in the viewer's surroundings by analyzing the lighting and color conditions of the ambient environment. The white point for the display device may then be adapted to be the determined white point from the viewer's surroundings. In one particular embodiment, this modification, or "white point adaptation," may be performed by "stretching" or otherwise modifying the values in the LUT such that the color "white" for the display is defined by finding the appropriate "white point" in the user's ambient environment. Additionally, modifications to the white point may be asymmetric between the LUT's Red, Green, and Blue channels, thereby moving the relative RGB mixture, and hence the white point.

In another embodiment, a color appearance model (CAM), such as the CIECAM02 color appearance model, provides the appropriate gamma boost based on the brightness and white point of the user's surroundings, as well as the field of view of the display subtended by the user's field of vision. In some embodiments, knowledge of the size of the display and the distance between the display and the user may also serve as useful inputs to the model. Information about the distance between the display and the user could be retrieved from a front-facing image sensor, such as front-facing camera 404. For example, for pitch black ambient environments an additional gamma boost of about 1.5 imposed by the LUT may be appropriate, whereas a 1.0 gamma boost (i.e., "unity," or no boost) may be appropriate for a bright or sun-lit environment. For intermediate surroundings, appropriate gamma boost values to be imposed by the LUT may be interpolated between the values of 1.0 and about 1.5. A more detailed model of surrounding conditions that can be used together with the embodiments described in connection with FIGS. 6A-12 is provided by the CIECAM02 specification.

In the embodiments described immediately above, the LUT 702 serves as a useful and efficient place for system 700 to impose these supplemental ambient/privacy element-based transformations on the input source data. It may be beneficial to use the LUT to implement these ambient/privacy element-based transformations because the LUT: (1) is easily modifiable, and thus convenient; (2) changes properties for the entire display device; (3) won't add any additional runtime overhead to the system; and (4) is already used to carry out similar style transformations for other purposes, as described above. In other embodiments, the adjustments determined by ambient/privacy model 704 may be applied through an enhanced color adaptation model 706. In some embodiments of an enhanced color adaptation model, gamma-encoded source data may first undergo linearization to remove the encoded gamma. At that point, gamut mapping may take place, e.g., via a color adaptation matrix. In the enhanced color adaptation model it may be beneficial to adjust the white point of the system based on the viewer's surroundings while mapping other color values to the gamut of the display device. Next, the black point compensation for the system could be performed to compensate for the effects of diffusive reflection. At this point in the enhanced color adaptation model, the already color-adapted data may be gamma encoded again based on the display device's characteristics with the additional gamma boost suggested by the CAM due to the user's surroundings. Finally, the data may be processed by the LUT and sent to the display. In those embodiments where adjustments determined by ambient/privacy model 704 are applied through the enhanced color adaptation model 706, no further modifications of the device's LUT table are necessary. In certain circumstances, it may be advantageous to impose the adjustments determined by ambient/privacy model 704 through the enhanced color adaptation model 706 rather than LUT. For example, adjusting the black point compensation during the color adaption stage could allow for the use of dithering to mitigate banding in the resultant display. Further, setting the white point while in linear space, i.e., at the time of gamut mapping, may be preferable to setting the white point using gamma encoded data, e.g., because of the ease of performing matrix operations in the linear domain, although transformations may also be performed in the non-linear domain, if needed.

Figure 8:
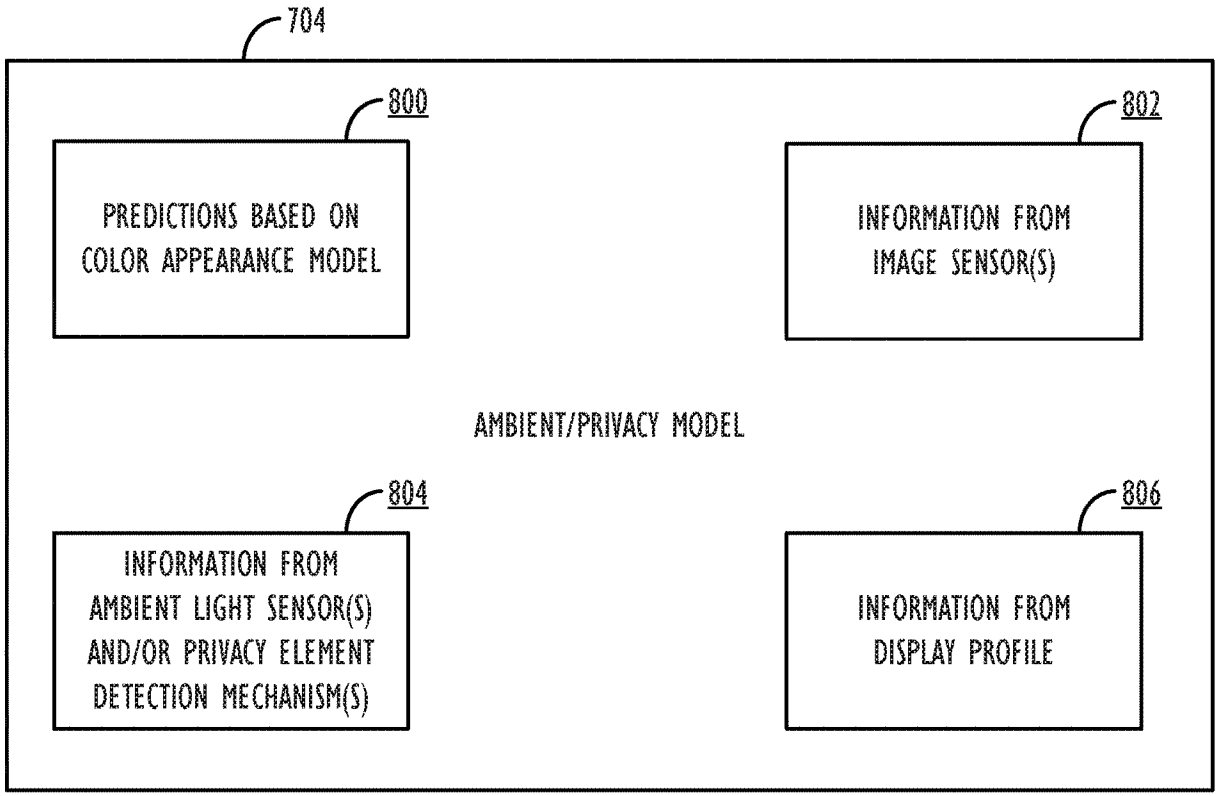
FIG. 8 illustrates a simplified functional block diagram of an ambient/privacy model (also referred to as a view model) in accordance with one embodiment.

Referring now to FIG. 8, a simplified functional block diagram of ambient/privacy model 704 may consider predictions from a color appearance model 800, information from image sensor(s) 802 (e.g., information indicative of diffuse reflection levels), information from ambient light sensor(s) and/or privacy element identification and detection mechanisms (PEDMs) 804, and information and characteristics from the display profile 806. Color appearance model 800 may comprise, e.g., the CIECAM02 color appearance model or the CIECAM97s model. Display profile 806 information may include information regarding the display device's color space, native display response characteristics or abnormalities, or even the type of screen surface used by the display. For example, an "anti-glare" display with a diffuser will "lose" many more black levels at a given (non-zero) ambient light level than a glossy display. The manner in which ambient/privacy model 704 processes information received from the various sources 800/802/804/806, and how it modifies the resultant tone response characteristics of the display, e.g., by modifying LUT values or via an enhanced color adaptation model, are up to the particular implementation and desired effects of a given system.

The overall goal of some color adaptation models may be to understand how the source material is ideally intended to "look" on a viewer's display. In a typical scenario for video, the ideal viewing conditions may be modeled as a broadcast monitor in a dim broadcast studio environment lit by 16 lux of CIE Standard Illuminant D65 light. This source rendering intent may be modeled, e.g., by attaching an ICC profile to the source. The attachment of a profile to the source data may allow the display device to interpret and render the content according to the source creator's "rendering intent." Once the rendering intent has been determined, the display device may determine how to transform the source content to make it match the ideal appearance on the display device, which may (and likely will) be a non-broadcast monitor, in an environment lit by non-D65 light, and with something other than 16 lux ambient lighting.

Figure 9:
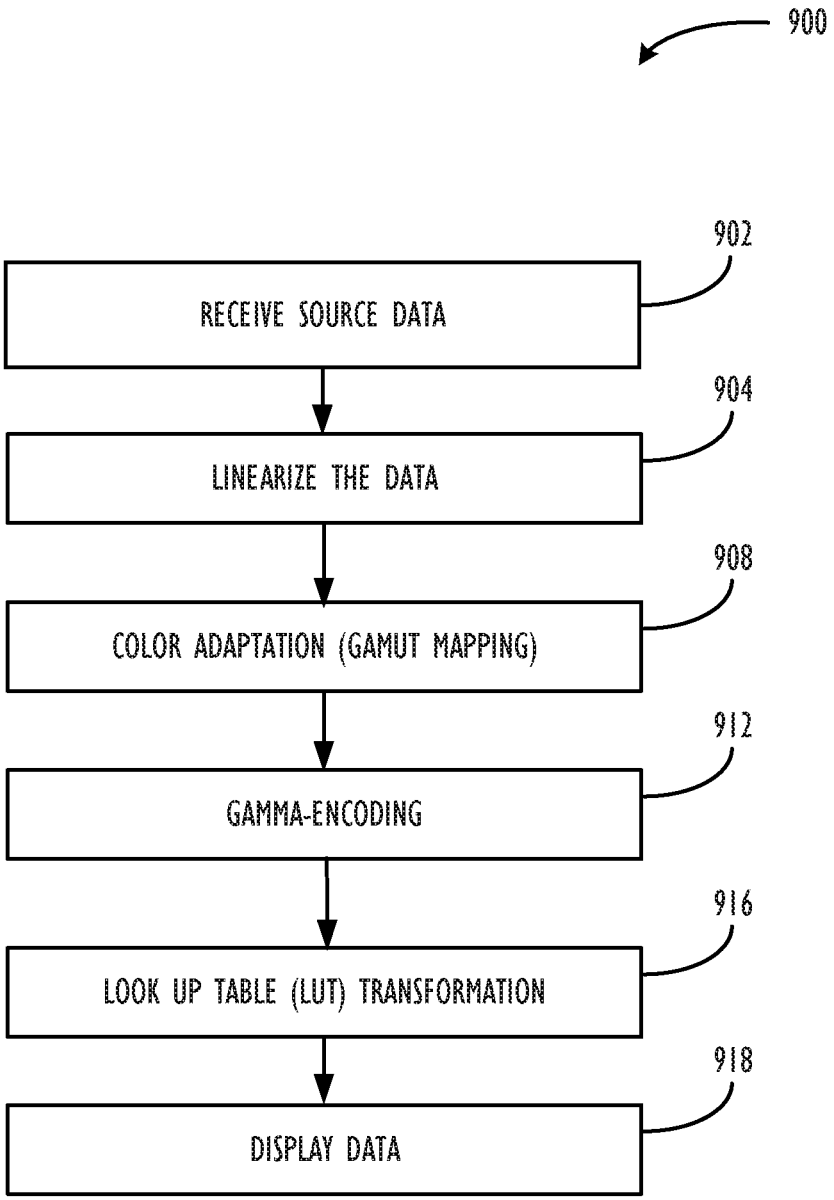
FIG. 9 illustrates, in flowchart form, one embodiment of a process for performing color adaptation.

Referring now to FIG. 9, in accordance with one embodiment the color adaptation process 900 begins at block 902. At this block 902, the process 900 may proceed with the color adaptation model receiving gamma-encoded data tied to the source color space (R'G'B'). The apostrophe after a given color channel, such as R', indicates that the information for that color channel is gamma encoded. Next the process 900 may perform a linearization operation in an attempt to remove the gamma encoding at block 904. For example, if the data has been encoded with a gamma of (1/2.2), the linearization operation may attempt to linearize the data by performing a gamma expansion with a gamma of 2.2. After linearization, the color adaptation process 900 will have a version of the data that is approximately representative of the data as it was in the source color space (RGB). At block 908, the process 900 may perform any number of gamut mapping techniques to convert the data from the source color space into the display color space. In one embodiment, the gamut mapping may use a 3×3 color adaptation matrix such as that employed by the ColorMatch framework. In other embodiments, a 3D LUT may be applied. The gamut mapping operation performed in block 908 may result in the model having the data in the display device's color space. The color adaptation process 900 may, at block 912, re-gamma encode the data based on the expected native display response of the display device. The gamma encoding operation performed in block 912 will result in the model having the gamma encoded data in the display device's color space. The gamma encoded data may now be passed to the LUT (block 916) to account for any imperfections in the display response of the display device, after which the data may be displayed on the display device (block 918). While FIG. 9 describes one generalized process for performing color adaptation in accordance with this disclosure, many variants of the process exist in the art and may be applied depending on the particular application.

Figure 10:
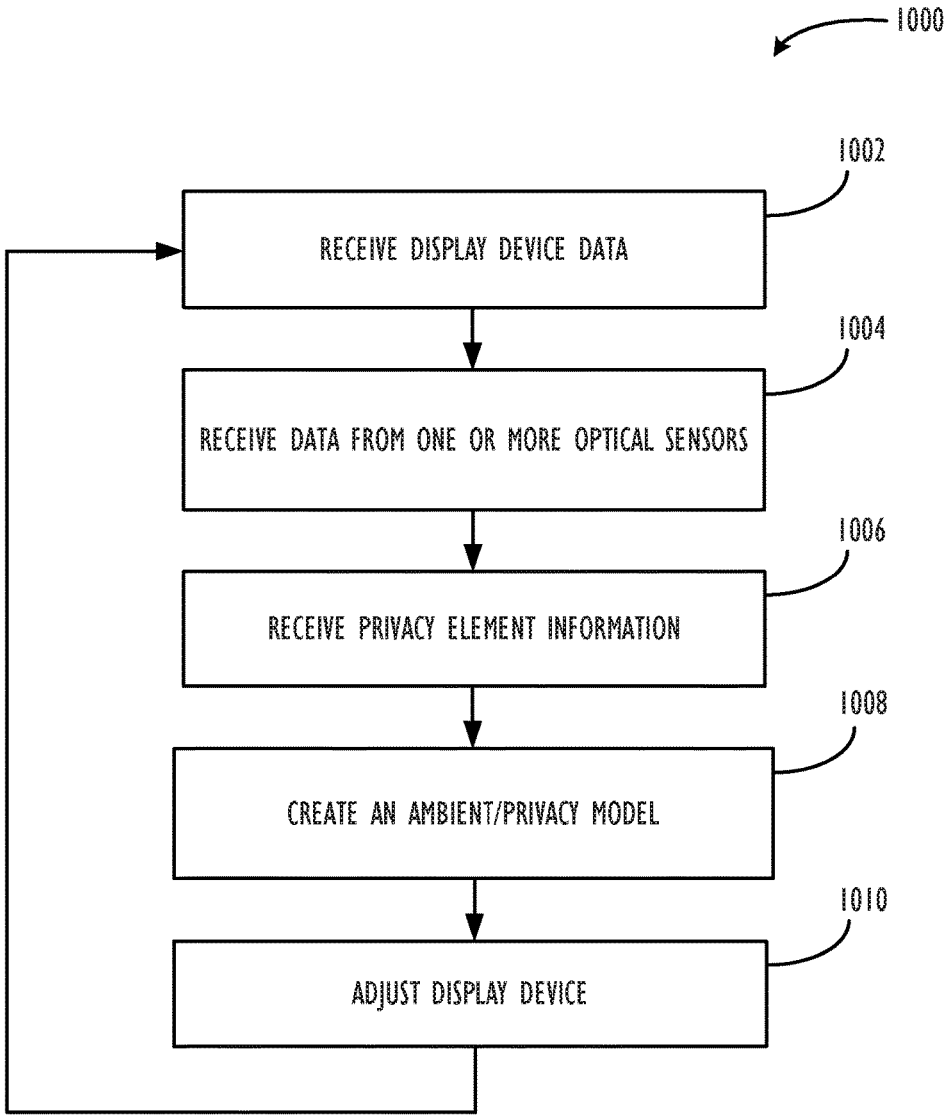
FIG. 10 illustrates, in flowchart form, one embodiment of a process for performing ambient/privacy element-aware dynamic display adjustment.

Referring now to FIG. 10, one embodiment of a process 1000 for performing ambient/privacy element-aware dynamic display adjustment is shown in flowchart form. First, the process 1000 begins at block 1002. Here, a processor or other suitable programmable control device receives data indicative of one or more of a display device's display characteristics. These may include the display's native response characteristics, or even the type of surface used by the display. Next, at block 1004, data from one or more optical sensors indicative of ambient light conditions in the display device's environment may be received. The process 1000 proceeds to block 1006, where data from one or more privacy element identification and detection mechanisms (PEDMs) and/or user input indicative of the presence, orientation, and/or type of privacy element being used in conjunction with the display device may be received. An ambient/privacy model based at least in part on the received data may be created at block 1008. In one embodiment, the created ambient model includes adjustments that may be applied to the gamma, black point, white point, or a combination thereof of the display device's response curve. Finally, at block 1010, one or more properties of the display device (such as the display device's reflectivity, brightness, white point, black point, field of view, tone response curve, color offset, etc.) may be made by modifying a LUT, based at least in part on the created ambient/privacy model, where after process 1000 continues to block 1002, which is described above.

Figure 11:
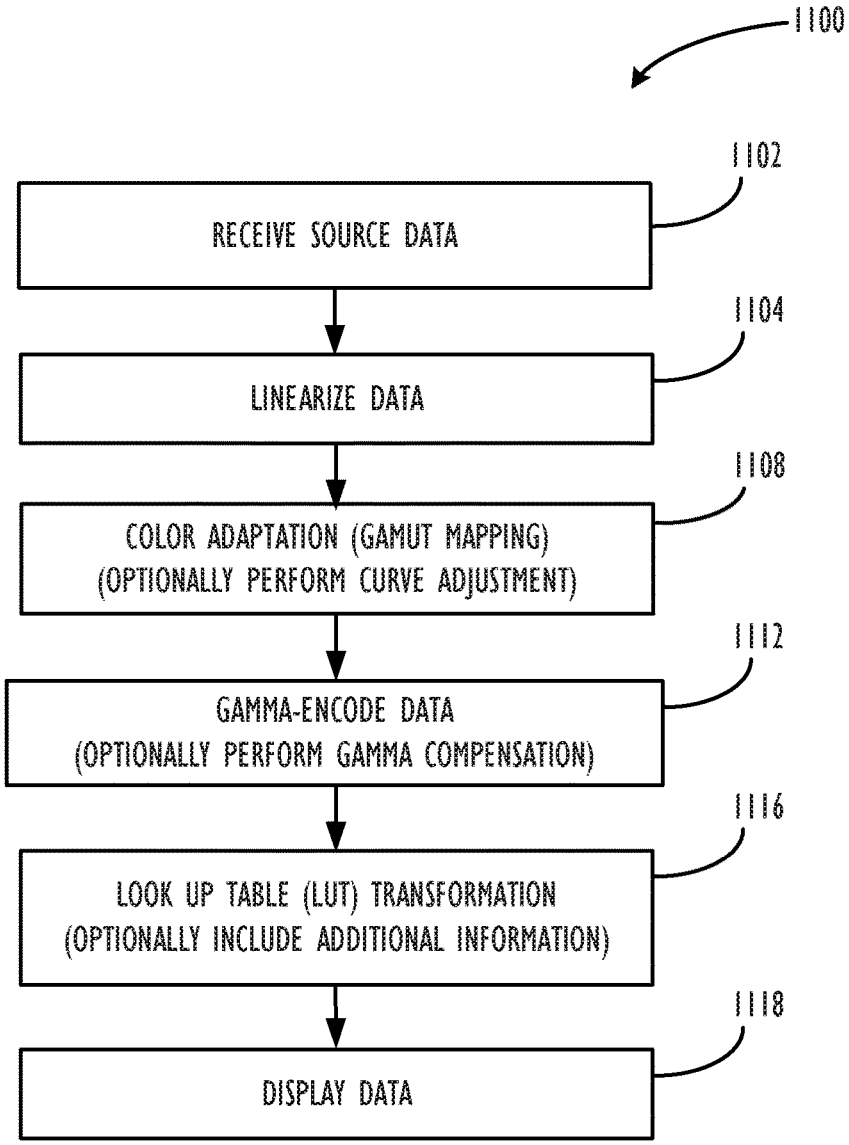
FIG. 11 illustrates, in flowchart form, another embodiment of a process for performing ambient/privacy element-aware dynamic display adjustment.

Referring now to FIG. 11, another embodiment of a process 1100 for performing ambient/privacy element-aware dynamic display adjustment is shown in flowchart form. This process 1100 is similar to the process 900 shown in FIG. 9, with modifications to show potential points in the color adaptation model where ambient/privacy element-aware display modifications may be imposed. Process 1100 begins at block 1102, where gamma-encoded data tied to the source color space (R'G'B') may be received. The received data may then be linearized at block 1104 to remove, to the extent possible, the gamma encoding. The result of operations performed in accordance with block 1104 is data that is approximately representative of the data as it was in the source color space (RGB). Next, at block 1108, any number of gamut mapping techniques may be applied to convert the data from the source color space into the display color space. In one embodiment, gamut mapping may be a useful technique to impose the white point compensation suggested by the ambient/privacy model. Because linear RGB data is operated upon at this stage, the color white in the source color space (R'G'B') may easily be mapped to the newly-determined representation of white for the display color space during gamut mapping. As an extension to this process 1100, black point compensation may also be imposed on the display color space. Performing black point compensation at this stage may also advantageously allow for the application of dithering to mitigate banding problems in the resultant display caused by, e.g., the compression of the source material into fewer, visible levels. Gamut mapping results in the model having the data in the display device's color space. The process 1100 proceeds to block 1112. At this block, the data may be re-gamma encoded based on the expected native display response of the display device. In one embodiment, gamma encoding may be a useful stage to impose additional gamma adjustments, i.e., transformations, suggested by the ambient/privacy model. The gamma encoding operations performed in accord with block 1112 may result in the model having the gamma encoded data in the display device's color space. At block 1116, the gamma encoded data is provided to the LUT. As mentioned above, the LUT may be used to impose any modification to the reflectivity, brightness, field of view tone response curve, color offset, gamma, white point, and/or black point (or combination thereof) of the display device suggested by the ambient/privacy model, as well as to account for any imperfections in the display response of the display device. Finally, process 1100 proceeds to block 1118, where the data may be displayed on the display device. While FIG. 11 describes one generalized process for performing ambient/privacy element-aware color adaptation, many variants of the process may be applied depending on the particular application.

Figure 12:
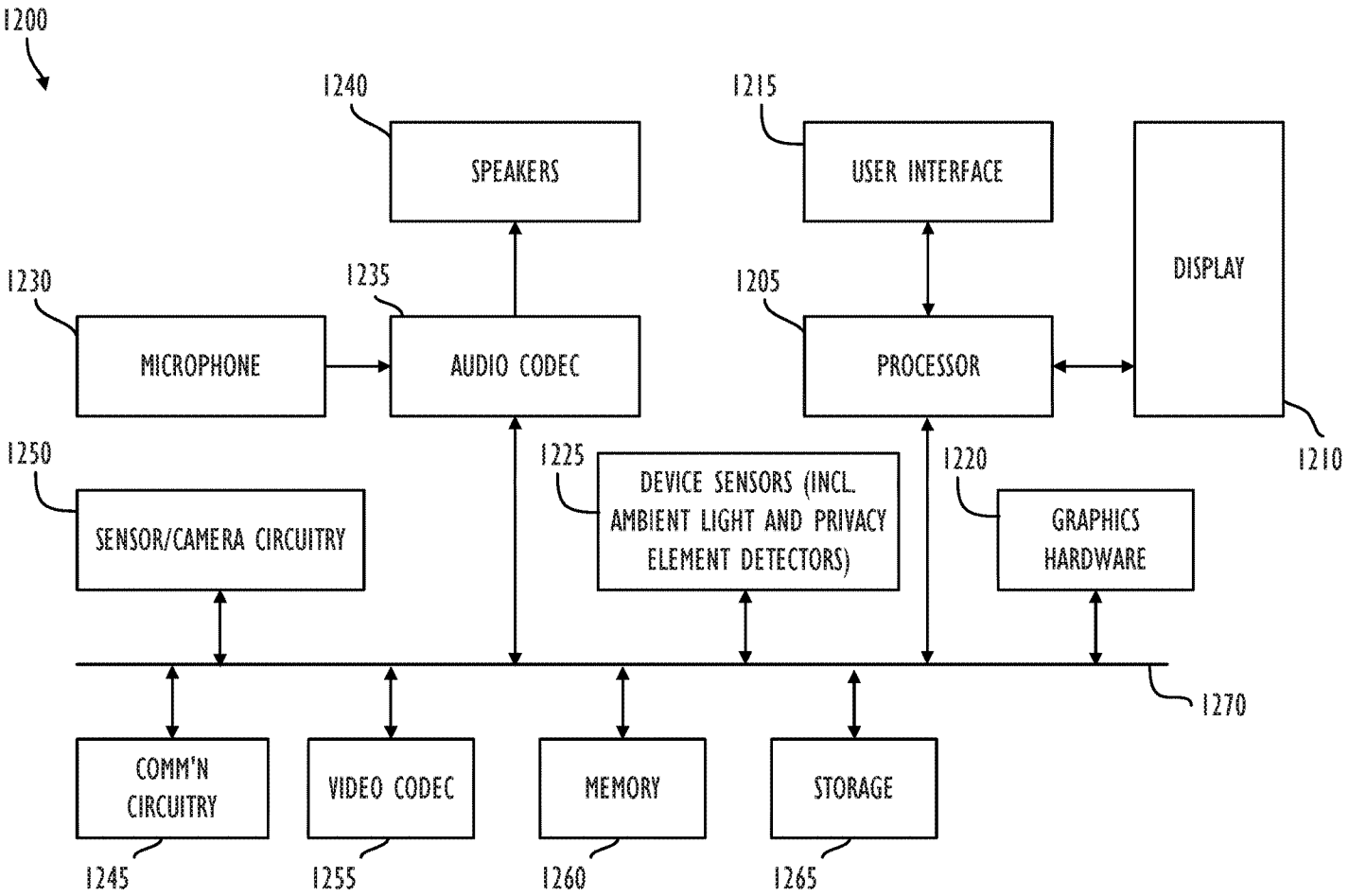
FIG. 12 illustrates a simplified functional block diagram of a device possessing a display in accordance with one embodiment.

Referring now to FIG. 12, a simplified functional block diagram of a representative electronic device possessing a display 1200 according to an illustrative embodiment is shown, e.g., a desktop computer and monitor possessing a camera device such as a front facing camera. The electronic device 1200 may include a processor 1205, display 1210, device sensors 1225 (including ambient light sensors and/or privacy element detection mechanisms), image sensor with associated camera hardware 1250, user interface 1215, memory 1260, storage device 1265, graphics hardware 1220, microphone 1230, audio codec 1235, speakers 1240, communication circuitry 1245, video codec 1255, and communications bus 1270. Processor 1205 may be any suitable programmable control device and may control the operation of many functions, such as the creation of the ambient-aware ambient model discussed above, as well as other functions performed by electronic device 1200. Processor 1205 may drive display 1210 and may receive user inputs from the user interface 1215.

Storage device 1265 may store media (e.g., image and video files), software (e.g., for implementing various functions on device 1200), preference information, device profile information, and any other suitable data. Storage device 1265 may include one more storage mediums, including for example, a hard-drive, permanent memory such as ROM, semi-permanent memory such as RAM, or cache.

Memory 1260 may include one or more different types of memory which may be used for performing device functions. For example, memory 1260 may include cache, ROM, and/or RAM. Communications bus 1270 may provide a data transfer path for transferring data to, from, or between at least storage device 1265, memory 1260, and processor 1205. User interface 1215 may allow a user to interact with the electronic device 1200. For example, the user input device 1215 can take a variety of forms, such as a button, keypad, dial, a click wheel, or a touchscreen.

In one embodiment, the personal electronic device 1200 may be an electronic device capable of processing and displaying media such as image and video files. For example, the personal electronic device 1200 may be a device such as such a mobile phone, personal data assistant (PDA), portable music player, monitor, television, laptop, desktop, and tablet computer, or other suitable personal device.

The foregoing description of preferred and other embodiments is not intended to limit or restrict the scope or applicability of the inventive concepts conceived of by the Applicants. As one example, although the present disclosure focused on desktop computer display screens, it will be appreciated that the teachings of the present disclosure can be applied to other implementations, such as portable and/or handheld electronic devices with display screens with which privacy screens may be utilized. In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method, comprising:

receiving first visually perceptible data to be presented by a display device;

receiving second data indicative of one or more characteristics of the display device;

receiving third data indicative of ambient light conditions in the display device's environment;

determine an ID of a privacy element coupled to the display device by using one or more privacy element identification and detection mechanisms (PEDMs) embedded in the display device;

creating a view model based, at least in part, on the received second data, the received third data, and fourth data determined to be associated with the privacy element based on the determined ID, wherein the view model comprises an adjustment to one or more operational characteristics of the display device;

adjusting the display device based on the created view model; and displaying, by the adjusted display device, the first data.

2. The method of claim 1, wherein the adjustment to the one or more operational characteristics of the display device comprises one or more determined adjustments to a brightness, gamma, white point, black point, reflectivity, field of view, color offset, or a combination thereof, of the display device based, at least in part, on the received second data, the received third data, and the fourth data.

3. The method of claim 2, wherein the adjustment to the one or more operational characteristics of the display device further comprise one or more determined adjustments to the display device based on a determination that one or more optical sensors used to acquire the third data are at least partially occluded by one or more privacy elements.

4. The method of claim 1, further comprising receiving the fourth data from at least one of: (i) the one or more PEDMs; and (ii) a data store communicatively coupled to the one or more PEDMs.

5. The method of claim 4, wherein receiving the fourth data further comprises determining a type or an orientation of the privacy element coupled to the display device, and wherein the adjustment to the one or more operational characteristics of the display device further comprise one or more determined adjustments to the display device based on the determination of the type or the orientation of the privacy element.

6. The method of claim 4, wherein the adjustment to the one or more operational characteristics of the display device further comprise one or more determined adjustments to the display device based on a determination that the received fourth data includes a request for the display device to enter a private mode, and wherein the request is based, at least in part, on the one or more PEDMs.

7. The method of claim 1, wherein the one or more PEDMs comprise one or more of a sensor and an RFID tag.

8. The method of claim 1, wherein the privacy element is coupled to the display device using one or more magnets.

9. An apparatus, comprising:

a display device;

one or more optical sensors;

one or more privacy element identification and detection mechanisms (PEDMs) embedded in the display device;

memory operatively coupled to the one or more optical sensors and the one or more PEDMs, wherein the memory stores instructions; and a processor operatively coupled to the display device, the memory, the one or more optical sensors, and the one or more PEDMs, wherein execution of the stored instructions by the processor causes the processor to:

receive first data to be presented by the display device, wherein the first data is visually perceptible;

receive second data indicative of one or more characteristics of the display device;

receive third data indicative of ambient light conditions in the display device's environment;

determine an ID of a privacy element coupled to the display device by using the one or more PEDMs;

create a view model based, at least in part, on the received second data, the received third data, and fourth data determined to be associated with the privacy element based on the determined ID, wherein the view model comprises an adjustment to one or more operational characteristics of the display device;

adjust the display device based on the created view model; and display, by the adjusted display device, the first data.

10. The apparatus of claim 9, wherein the adjustment to the one or more operational characteristics of the display device comprises one or more determined adjustments to a brightness, gamma, white point, black point, reflectivity, field of view, color offset, or a combination thereof, of the display device based, at least in part, on the received second data, the received third data, and the fourth data.

11. The apparatus of claim 10, wherein the adjustment to the one or more operational characteristics of the display device further comprises one or more determined adjustments to the display device based on a determination that the one or more optical sensors used to acquire the third data are at least partially occluded by one or more privacy elements.

12. The apparatus of claim 9, wherein execution of the stored instructions by the processor further causes the processor to receive the fourth data from at least one of: (i) the one or more PEDMs; and (ii) a data store communicatively coupled to the one or more PEDMS.

13. The apparatus of claim 12, wherein the instructions executed by the processor to cause the processor to receive the fourth data further comprises instructions executed by the processor to cause the processor to determine a type or an orientation of the privacy element coupled to the display device, and wherein the adjustment to the one or more operational characteristics of the display device further comprises one or more determined adjustments to the display device based on the determination of the type or the orientation of the privacy element.

14. The apparatus of claim 12, wherein the adjustment to the one or more operational characteristics of the display device further comprises one or more determined adjustments to the display device based on a determination that the received fourth data includes a request for the display device to enter a private mode, and wherein the request is based, at least in part, on the one or more PEDMs.

15. The apparatus of claim 9, wherein the one or more PEDMs comprise one or more of a sensor and an RFID tag.

16. The apparatus of claim 9, wherein the privacy element is coupled to the display device using one or more magnets.

17. A non-transitory computer-readable storage medium storing instructions, which when executed by a processor, cause the processor to:

receive first data to be presented by a display device, wherein the first data is visually perceptible;

receive second data indicative of one or more characteristics of the display device;

receive third data indicative of ambient light conditions in the display device's environment;

determine an ID of a privacy element coupled to the display device by using one or more privacy element identification and detection mechanisms (PEDMs) embedded in the display device;

create a view model based, at least in part, on the received second data, the received third data, and fourth data determined to be associated with the privacy element based on the determined ID, wherein the view model comprises an adjustment to one or more operational characteristics of the display device;

adjust the display device based on the created view model; and display, by the adjusted display device, the first data.

18. The non-transitory computer-readable storage medium of claim 17, wherein the adjustment to the one or more operational characteristics of the display device comprises one or more determined adjustments to a brightness, gamma, white point, black point, reflectivity, field of view, color offset, or a combination thereof, of the display device based, at least in part, on the received second data, the received third data, and the fourth data.

19. The non-transitory computer-readable storage medium of claim 17, wherein the adjustment to the one or more operational characteristics of the display device further comprises one or more determined adjustments to the display device based on a determination that one or more optical sensors used to acquire the third data are at least partially occluded by one or more privacy elements.

20. The non-transitory computer-readable storage medium of claim 17, wherein execution of the stored instructions by the processor further causes the processor to receive the fourth data from at least one of: (i) the one or more PEDMs; and (ii) a data store communicatively coupled to the one or more PEDMs.

21. The non-transitory computer-readable storage medium of claim 20, wherein the instructions, which when executed by the processor, cause the processor to receive the fourth data further comprises instructions, which when executed by the processor, cause the processor to determine a type or an orientation of the privacy element coupled to the display device, and wherein the adjustment to the one or more operational characteristics of the display device further comprises one or more determined adjustments to the display device based on the determination of the type or the orientation of the privacy element.

22. The non-transitory computer-readable storage medium of claim 20, wherein the adjustment to the one or more operational characteristics of the display device further comprises one or more determined adjustments to the display device based on a determination that the received fourth data includes a request for the display device to enter a private mode, and wherein the request is based, at least in part, on the one or more PEDMs.

23. The non-transitory computer-readable storage medium of claim 17, wherein the one or more PEDMs comprise one or more of a sensor and an RFID tag.

24. The non-transitory computer-readable storage medium of claim 17, wherein the privacy element is coupled to the display device using one or more magnets.

* * * * *